US006702092B2

(12) United States Patent
Nakajima et al.

(10) Patent No.: US 6,702,092 B2
(45) Date of Patent: Mar. 9, 2004

(54) COIN ASSORTER

(75) Inventors: Kenji Nakajima, Tokyo (JP); Yasuyuki Kodama, Tokyo (JP); Takahiro Hayashi, Tokyo (JP); Masato Yagi, Tokyo (JP); Shinichi Kosugi, Tokyo (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 171 days.

(21) Appl. No.: 10/111,210

(22) PCT Filed: Jul. 4, 2001

(86) PCT No.: PCT/JP01/05825

§ 371 (c)(1),
(2), (4) Date: Apr. 22, 2002

(87) PCT Pub. No.: WO02/17243

PCT Pub. Date: Feb. 28, 2002

(65) Prior Publication Data

US 2002/0162725 A1 Nov. 7, 2002

(30) Foreign Application Priority Data

Aug. 23, 2000 (JP) ..... 2000-252438

(51) Int. Cl.[7] ..... G07D 7/00; G07F 1/04

(52) U.S. Cl. ..... 194/302; 194/344

(58) Field of Search ..... 194/302, 344, 194/346, 350; 193/DIG. 1

(56) References Cited

U.S. PATENT DOCUMENTS 1,963,402 A * 6/1934 Comer ..... 194/324
2,128,337 A * 8/1938 Weiss et al. ..... 194/302
4,693,357 A * 9/1987 Aschenbeck et al. ..... 194/202
5,483,583 A * 1/1996 Chen ..... 379/146

FOREIGN PATENT DOCUMENTS

GB 2.097.161 A * 10/1982 ..... G07F/9/04

* cited by examiner

*Primary Examiner*—Donald P. Walsh
*Assistant Examiner*—Mark J. Beauchaine
(74) *Attorney, Agent, or Firm*—Welsh & Katz, Ltd.

(57) ABSTRACT

A coin assorter (1), wherein a particular coin route (32) having a coin retaining mechanism (100) disposed therein is formed, meanderingly generally in S-shape, on the upstream side of the coin retaining mechanism (100) to set longer the route length of the particular coin route (32) having the coin retaining mechanism (100) disposed therein in order to increase the number of coins (C) temporarily retained in the route length.

4 Claims, 26 Drawing Sheets

COIN ASSORTER

TECHNICAL FIELD

The present invention relates to a coin processing apparatus used in an apparatus such as an automatic vending machine, money changing machine or service machine, that sorts and stores inserted coins according to denomination, and that pays out the sorted and stored coins as change, and more particularly, to an improvement regarding a coin assorter that can determine whether inserted coins are genuine or not and can sort genuine coins according to denomination.

BACKGROUND ART

Apparatus such as an automatic vending machine, money changing machine or service machine currently in use has been provided with a coin processing apparatus that sorts and stores inserted coins according to denomination and pays out the sorted and stored coins as change.

This coin processing apparatus generally comprises four components:

- a housing constituting the apparatus main body of the coin processing apparatus;
- a coin assorter, located at the top of this housing, that determines whether inserted coins are genuine or false and sorts the genuine coins according to denomination;
- a coin storage unit, located inside the housing and below the coin assorter, that comprises a plurality of coin tubes that accumulate and store according to denomination genuine coins that were sorted by denomination; and
- a coin payout unit, located inside the housing and below the coin storage unit, that pays as change the genuine coins stored inside the coin storage unit.

Meanwhile, in an automatic vending machine in which is installed a coin processing apparatus having the above construction, where a product purchaser terminates the product purchase for some reason after inserting the coins that were to pay for the intended product and wants the coins to be returned, the purchaser operates a coin return lever located on the automatic vending machine.

When this is done, because an amount of coins equal to the amount of money inserted is returned to the coin return outlet, the product purchaser who desires the return of the inserted coins can collect the coins that were returned to the coin return outlet.

Incidentally, in the generally-used coin processing apparatus described above, this coin return processing is based on the operation of a coin return lever, and is carried out through payment by the coin payout unit of coins equal in amount to the coins inserted, such payment being made from the coin storage unit to the coin return outlet.

In other words, in the generally-used coin processing apparatus, where coin return processing is carried out, the coins paid out to the coin return outlet are not the same coins that were inserted by the product purchaser. Instead, coins equal in amount to the coins inserted are paid out to the coin return outlet from among the genuine coins previously stored in the coin storage unit.

In this way, in the conventional coin processing apparatus, where inserted coins are to be returned, the coins that were actually inserted are not paid out, and instead coins equal in amount to the coins inserted are paid out to the coin return outlet from among the genuine coins previously stored in the coin storage unit. Therefore, if someone inserts into the coin processing apparatus counterfeit coins (false coin) that are realistic enough to be deemed genuine by the coin assorter and then operates the coin return lever without purchasing a product, genuine coins in an amount equal to the amount inserted are paid out even though the coins inserted were counterfeit, and as a result, the so-called coin switching phenomenon occurs.

In order to prevent such coin switching, a so-called same-coin return-type coin processing apparatus has been proposed in the conventional art, such as that disclosed in Japanese Patent Laid-Open No. 11-288480, in which a coin assorter installed in the apparatus includes a coin retaining lever located at the downstream end of each individual coin route to which are connected a plurality of denomination distributing levers that sort by denomination coins that are determined to be genuine, i.e., at the downstream end of each coin route into which coins are ultimately sorted and guided by denomination. When inserted coins are temporarily retained inside the coin routes by the coin retaining levers and if the coin return lever is operated without a product being purchased, the hold on the inserted coins being retained temporarily in the coin routes by the coin retaining levers is cancelled, and the inserted coins themselves are paid out to the coin return outlet.

According to the same-coin return-type coin processing apparatus with a coin assorter disclosed in Japanese Patent Laid-Open No. 11-288480, where the coin return lever is operated and coins are to be returned, because the coins that were actually inserted are paid out, even where counterfeit coins (false coin) that are realistic enough to be deemed genuine by the coin assorter are inserted, the inserted coins (false coin) themselves are paid out to the coin return outlet. As a result the occurrence of the coin switching phenomenon is eliminated to the maximum possible extent.

In addition to the apparatus disclosed in Japanese Patent Laid-Open No. 11-288480, the conventional art also includes a same-coin return-type coin processing apparatus that includes a coin assorter wherein, when a plurality of high-value coins (a 500-yen coin and a 100-yen coin, for example) are retained temporarily in their coin routes in accordance with the length thereof and the return lever is operated without a product purchase, the temporarily retained multiple coins are returned as a group to the coin return outlet.

However, the conventional coin assorters used in the same-coin return-type coin processing apparatuses described above entail the problem that, due to the short length of the coin routes to which the coin retaining levers for temporarily retaining inserted coins are connected, the number of coins that can be retained temporarily is small, and as a result, the automatic vending machine cannot handle more costly products that require a large number of coins, thereby reducing the variety of products that can be offered.

With the foregoing in view, an object of the present invention is to provide a coin assorter that can increase the number of inserted coins that can be temporarily retained and prevent to the maximum possible extent the occurrence of the coin switching phenomenon.

DISCLOSURE OF THE INVENTION

In order to achieve the above object, in the coin assorter of the present invention, a particular coin route to which said coin retaining means is provided is curved substantially in an S-shape upstream from said coin retaining means, whereby the length of said respective coin routes to which said coin retaining means is provided is set to be long, so that a large number of coins can be temporarily retained therein.

BEST MODE FOR CARRYING OUT THE INVENTION

Embodiment of the coin assorter according to the present invention will be described in detail below.

Figure 1:
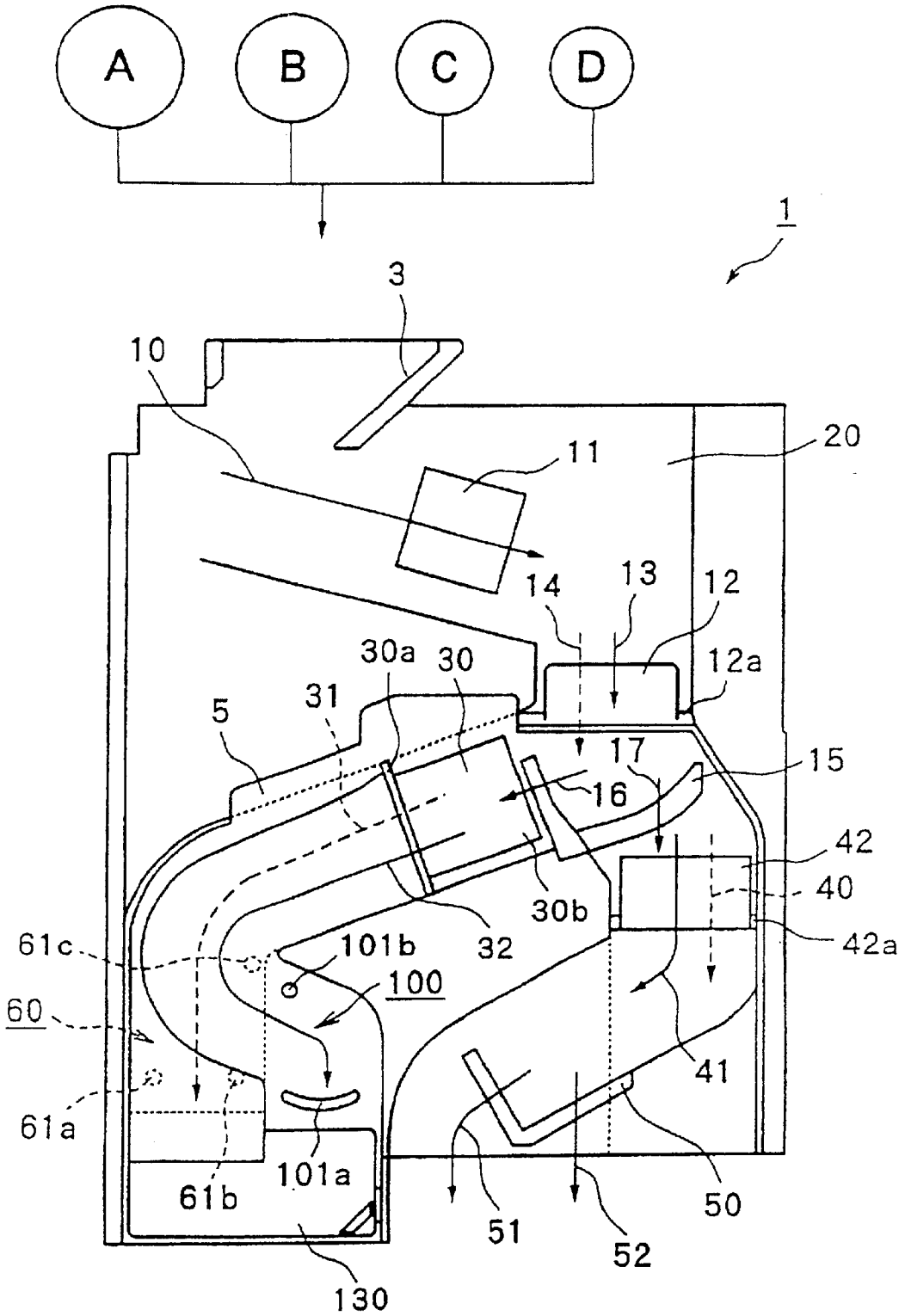
FIG. 1 is a schematic front elevation of the coin assorter according to the present invention.

FIG. 1 is a schematic front elevation of the coin assorter according to the present invention.

This coin assorter 1 basically makes assortment into the four types of coins having mutually different diameters; A-type genuine coins (500-yen coins), B-type genuine coins (10-yen coins), C-type genuine coins (100-yen coins) and D-type genuine coins (50-yen coins), and false coins.

A coin discrimination route 10 that slants downward to the right in the drawing is located directly below the coin insertion opening 3, and a coin discrimination sensor 11 that determines coins as genuine or false is located partway down the coin discrimination route 10.

At the same time, a genuine/false coin distributing lever 12 that comprises a genuine/false coin sorting unit that sorts the coins forwarded from the coin discrimination route 10 into genuine and false coins and guides genuine and false coins into their own separate routes is located at the terminal end of the coin discrimination route 10.

This genuine/false coin distributing lever 12 is the type of distributing lever wherein the top edge opens and closes in the direction perpendicular to the drawing while revolving around an shaft 12*a* located at the bottom edge thereof.

By virtue of this genuine/false coin distributing lever 12, the terminal end of the coin route 10 is bifuircated into a false coin ejection route 13 that guides the false inserted coins and a first coin sorting route 14 that guides only coins that are deemed to be genuine.

Figure 2:
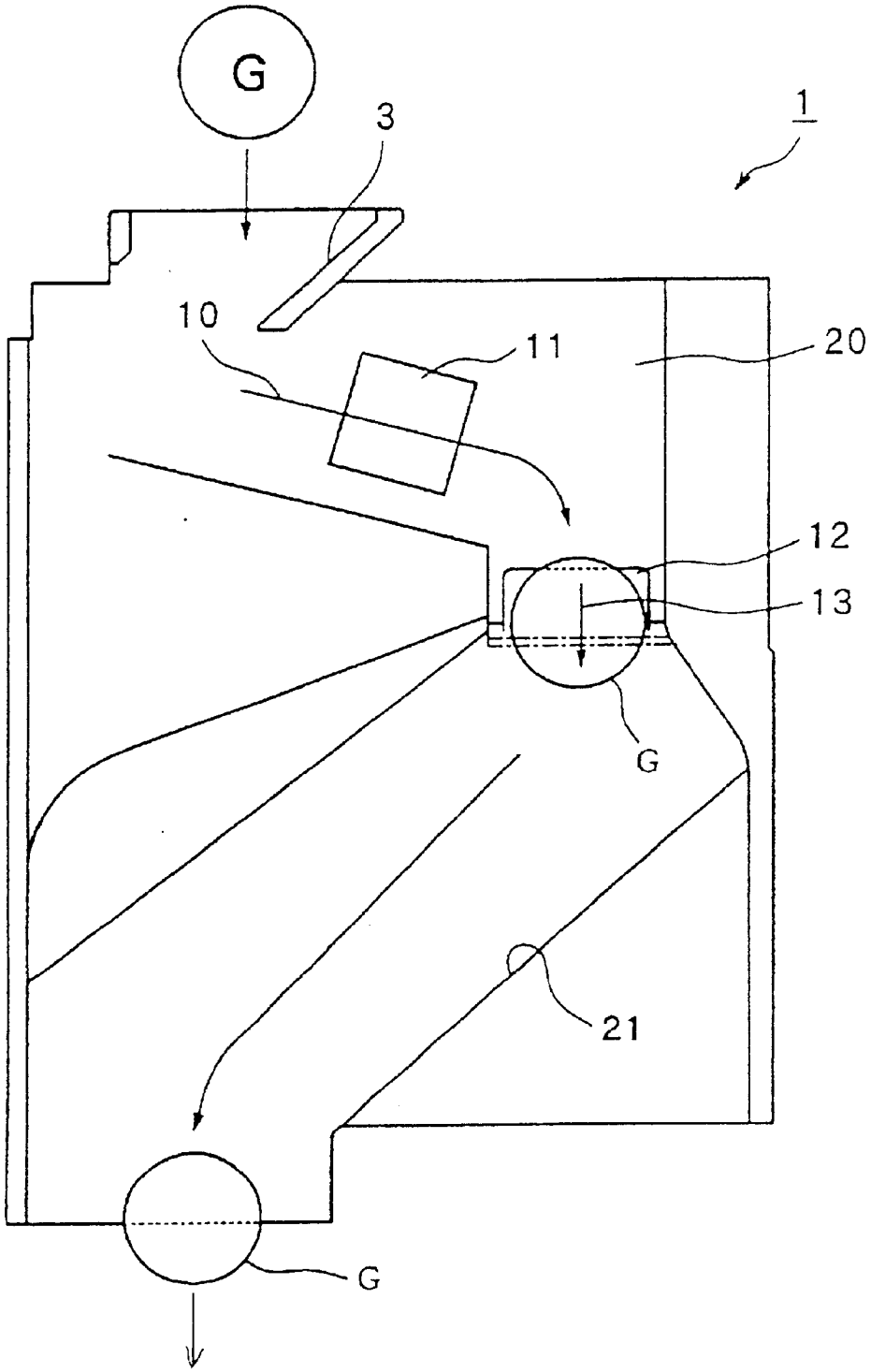
FIG. 2 is a schematic front elevation showing the operation of the coin assorter according to the present invention.

The false coin ejection route 13, one of the coin routes formed at the terminal end of the coin discrimination route 10, is connected to a false coin ejection chute 21 formed in a slanted fashion relative to the front of the coin assorter, as shown in FIG. 2. This false coin ejection chute 21 is connected to a false coin return outlet not shown in the drawings, and the false coins G guided to the false coin ejection chute 21 are returned to the coin return outlet via the false coin ejection chute 21 as shown by the arrow in the drawing.

A first denomination distributing lever 15, which comprises a denomination sorting unit that sorts the coins which were forwarded from the first coin sorting route 14 after being determined as genuine, and which belong to the four categories of A, B, C and D genuine coins into two groups comprising an A-type coin and C-type coin group and a B-type coin and D-type coin group, is located at the downstream end of the first coin sorting route 14 shown in FIG. 1.

Due to the first denomination distributing lever 15, the first coin sorting route 14 is bifurcated into a second coin sorting route 16 that guides only coins belonging to the A-type/C-type coin group and is angled to the left in the drawing, and a third coin sorting route 17 that guides only coins belonging to the B-type/D-type coin group and runs downward in the drawing.

In addition, the front surface of the entire first denomination distributing lever 15 described above is formed in essentially an L shape.

Figure 3:
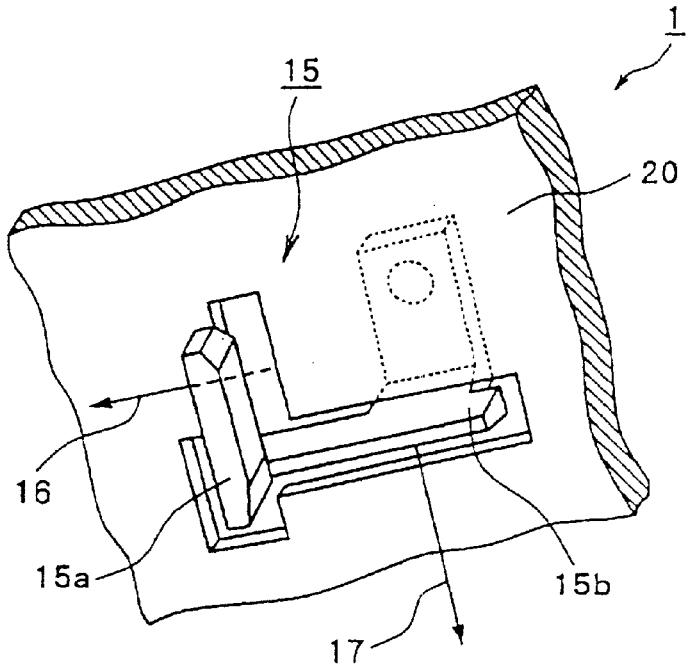
FIG. 3 is an schematic perspective view showing the main portion of the operation of a first denomination distributing lever.
Figure 4:
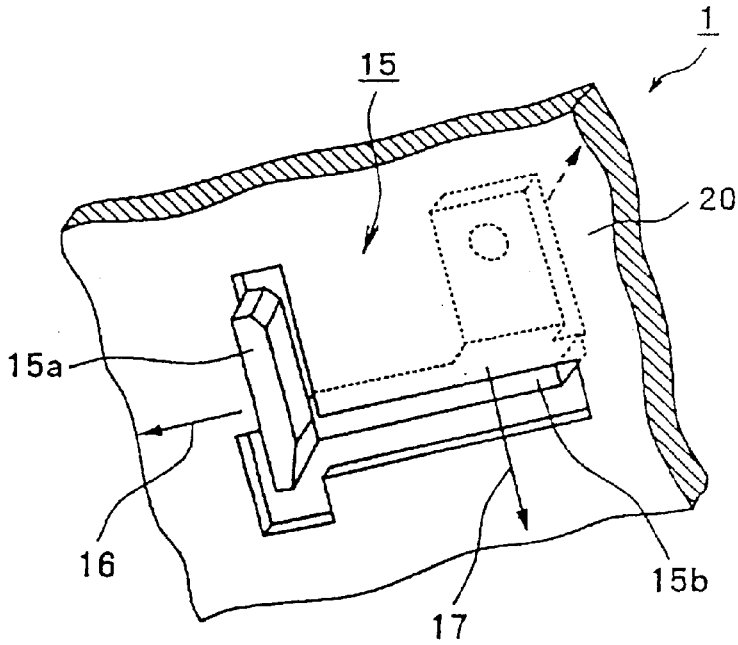
FIG. 4 is an schematic perspective view showing the main portion of the operation of the first denomination distributing lever.

This first denomination distributing lever 15 comprises a first gate 15*a* that opens up the second coin sorting route 16 located to the side when the first gate 15*a* protrudes from the surface of the main plate 20 as shown in FIG. 3, which comprises an expanded schematic perspective view of the important parts of FIG. 1, and closes off the second coin sorting route 16 when it is retracted toward the main plate 20 as shown in FIG. 4, as well as a second gate 15*b* that closes off the third coin sorting route 17 located at the bottom when it protrudes from the main plate 20 as shown in FIG. 3, and opens up the third coin sorting route 17 when it is retracted toward the main plate 20 as shown in FIG. 4.

When the first denomination distributing lever 15 protrudes from the main plate 20 as shown in FIG. 3, because the second coin sorting route 16 is opened up while the third coin sorting route 17 is closed off, only the A-type/C-type coin group is guided to the second coin sorting route 16.

Similarly, when the first denomination distributing lever 15 is retracted toward the main plate 20 as shown in FIG. 4, because the second coin sorting route 16 is closed off while the third coin sorting route 17 is opened up, only the B-type/D-type coin group is guided to the third coin sorting route 17.

At the same time, as shown in FIG. 1, a second denomination distributing lever 30 that comprises a second denomination sorting unit that sorts the coins in the A-type/C-type coin group that are forwarded to the second coin sorting route 16 into A-type coins and C-type coins is located at the downstream end of the second coin sorting route 16. Due to the second denomination distributing lever 30, the second coin sorting route 16 is bifurcated into a fourth coin sorting route 31 that guides only A-type coins, and a fifth coin sorting route 32 that guides only C-type coins and is formed on the top surface of the fourth coin sorting route 31.

The fourth coin sorting route 31 that guides only A-type coins (indicated by a dashed line) is formed essentially in an L configuration tracing the direction of coin movement, while the fifth coin sorting route 32 (indicated by a solid line) that guides only C-type coins and is separated from the fourth coin sorting route 31 by a partition plate 5 or the like located at the top part of the fourth coin route 31 is curved essentially in an S shape tracing the direction of coin movement in order to make the coin route as long as possible.

The second denomination distributing lever 30 described above is the type of distributing lever wherein the rightmost edge 30*b* opens and closes in the direction perpendicular to the drawing while revolving around an shaft 30*a* located at the leftmost edge thereof.

Furthermore, as shown in FIG. 1, a third denomination distributing lever 42, which comprises a third denomination sorting unit that sorts coins into a sixth coin sorting route 40 that extends to a cash box not shown in the drawings and is formed behind the main plate 20 and a seventh coin sorting route 41, is located at the downstream end of the third coin sorting route 17.

When the numbers of B-type coins and D-type coins accumulated and stored in the corresponding coin tubes of the coin storage unit not shown in the drawings reach a certain number, respectively, B-type coins or D-type coins that are subsequently inserted are sorted and guided by the third denomination distributing lever 42 to the sixth sorting route 40 that leads to the cash box.

Whether or not the number of coins accumulated inside each coin tube of the coin storage unit has reached a certain number is determined based on the detection by a known filled-up sensor comprising a photosensor or the like located at a prescribed position within each coin tube.

The third denomination distributing lever 42 is also a distributing lever of a type wherein the top edge opens and closes in the direction perpendicular to the drawing while revolving around an shaft 42*a* located at the bottom edge thereof.

Moreover, as shown in FIG. 1, a fourth denomination distributing lever 50 that comprises a fourth denomination sorting unit that sorts into B-type coins and D-type coins the coins in the B-type/D-type coin group that are guided to the seventh coin sorting route 41 is located at the downstream end of the seventh coin sorting route 41.

This fourth denomination distributing lever 50 is a lever having a construction identical to that of the first denomination distributing lever 15. When the fourth denomination distributing lever 50 protrudes from the main plate 20, because the eighth coin sorting route 51 is opened up while the ninth coin sorting route 52 is closed off, only B-type coins are guided to the eighth coin sorting route 51. Similarly, when the fourth denomination distributing lever 50 is retracted toward the main plate 20, because the eighth coin sorting route 51 is closed off while the ninth coin sorting route 52 is opened up, only D-type coins are guided to the ninth coin sorting route 52.

Figure 5:
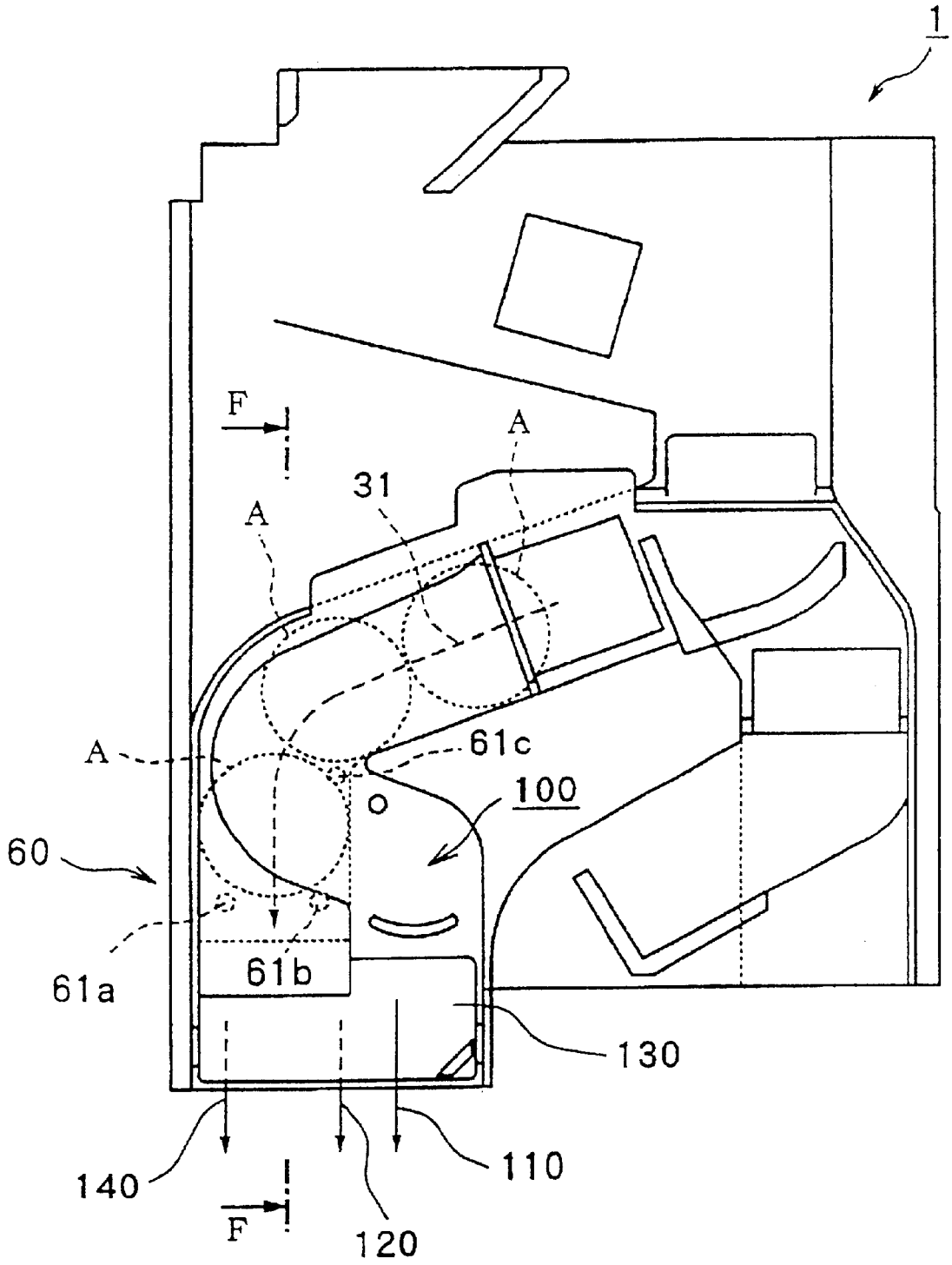
FIG. 5 is a drawing showing the temporary retaining of an A-type coin.

As shown in FIG. 5, at the downstream end of the essentially L-shaped fourth coin sorting route 31 described above, is first coin retaining means 60 comprising a coin retaining lever that temporarily retains inside the fourth coin sorting route 31 a plurality (up to a maximum of three) o f A-type coins that have passed through the fourth coin sorting route 31 is provided.

Figure 6:
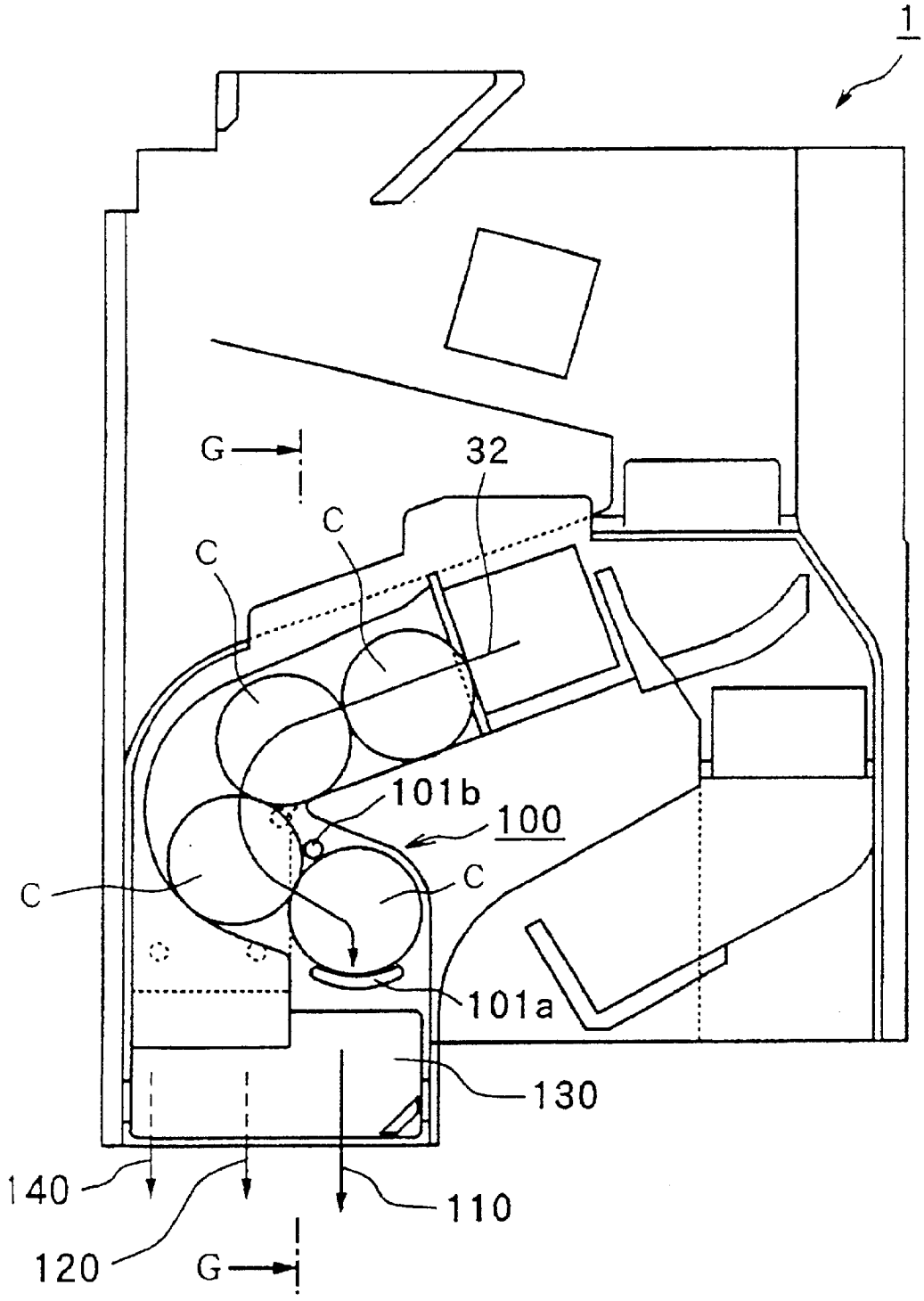
FIG. 6 is a view showing the temporary retaining of a C-type coin.

Furthermore, as shown in FIG. 6, at the downstream end of the essentially S-shaped fifth coin sorting route 32 described above and shown in FIG. 1, is second coin retaining means 100 comprising a coin retaining lever that temporarily retains inside the fifth coin sorting route 32 a plurality (up to a maximum of four) of C-type coins that have passed through the fifth coin sorting route 32 is provided.

The first coin retaining means 60 that temporarily retains A-type coins inside the fourth coin sorting route 31 and the second coin retaining means 100 that temporarily retains C-type coins inside the fifth coin sorting route 32 will be described in detail later.

Figure 7:
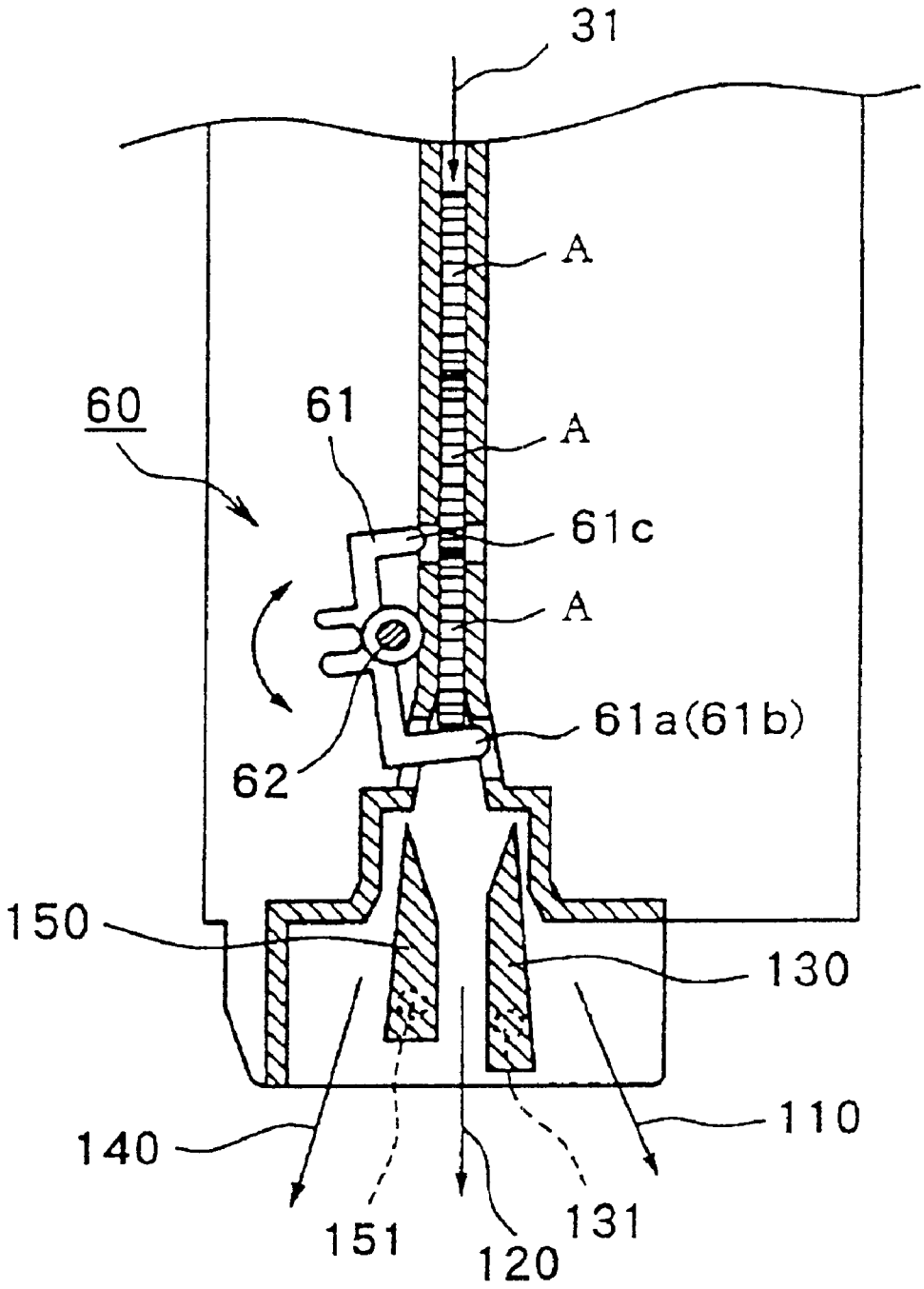
FIG. 7 is a schematic cross-section of the representation shown in FIG. 5 cut along the F—F line and showing the main portion thereof.

Meanwhile, as shown in FIG. 1 and in FIG. 7 showing a cross-section of FIG. 5 cut along the F—F line, at each of the bottom end of both the first coin retaining means 60 that temporarily retains A-type coins and the second coin retaining means 100 that temporarily retains C-type coins, there are provided side by side a first coin distributing lever 130 that sorts the coins into either a coin return route 110 (see FIG. 7) that guides A and C-type coins that were temporarily retained by the first coin retaining means 60 and the second coin retaining means 100 to the false coin ejection chute 21 shown in FIG. 2, or into a coin storage route 120 (see FIG. 7) that guides the coins into the corresponding coin tube of the coin retaining mechanism located therebelow and not shown in the drawings; and, as shown in FIG. 7, a second coin distributing lever 150 that is located behind the first distributing lever 130 and sorts the coins into either the coin storage route 120 that guides the A and C-type coins that were temporarily retained by the first coin retaining means 60 and the second coin retaining means 100 into the corresponding coin tube of the coin retaining mechanism located therebelow or into a cash box route 140 that leads to the cash box and not shown in the drawings.

This first coin distributing lever 130 and second coin sorting 150 are described in detail later Of the first coin retaining means 60 and the second coin retaining means 100 described above, the first coin retaining means 60 that retains A-type coins comprises a coin retaining lever 61 that has a C-shaped cross-section and temporarily retains A-type coins that have passed through the fourth coin route 31 and have been determined to be A-type coins; and first retaining unit driving means, not shown in the drawings, that comprises a solenoid or the like that causes the coin retaining lever 61 to revolve around its shaft 62.

With regard to this first coin retaining means 60, in the initial state shown in FIG. 1, a pair of cylindrical proximal end portions 61*a* and 61*b* continuously receive force from the first retaining unit driving means comprising a solenoid or the like and not shown in the drawings which causes them to revolve counterclockwise around the shaft 62 and are then stopped from moving, and as a result, this pair of proximal end portions 61*a* and 61*b* are caused to protrude into the interior of the fourth coin sorting route 31, thereby closing off the downstream end of the fourth coin sorting route 31, while the cylindrical distal end portion 61*c* is retracted from the interior of the fourth coin sorting route 31, thereby opening up the upstream end of the fourth coin sorting route 31, as shown in FIG. 7.

In this initial state, when a single A-type coin is guided into the fourth coin sorting route 31 as shown in FIGS. 5 and 7, the pair of proximal end portions 61*a* and 61*b* of the coin retaining lever 61 retain the A-type coin by supporting the circumferential surface thereof, and when a plurality of (three) A-type coins are guided into the fourth coin sorting route 31 after this A-type coin has been retained, these three A-type coins are successively retained temporarily inside the fourth coin sorting route 31 by the pair of proximal end portions 61*a* and 61*b*. Needless to say, the number of coins temporarily retained inside the fourth coin sorting route 31 depends on the length thereof.

Figure 8:
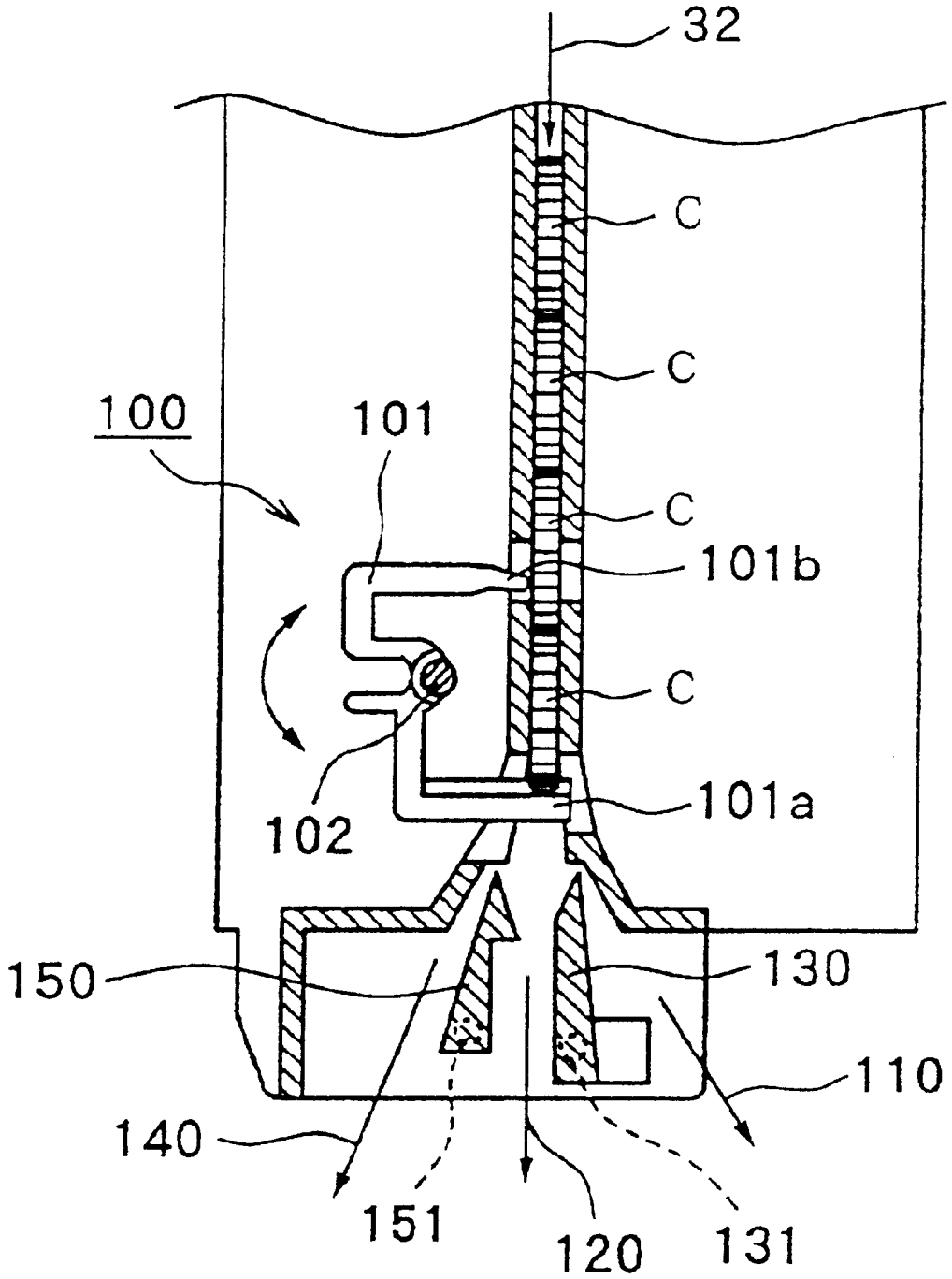
FIG. 8 is a schematic cross-section of the representation shown in FIG. 6 cut along the G—G line and showing the main portion thereof.

As shown in FIG. 8 showing an enlarged schematic cross-section of FIG. 6 cut along the G—G line, the above second coin retaining means 100 that retains C-type coins comprises a second coin retaining lever 101 that has a C-shaped cross-section and temporarily retains C-type coins that have passed through the fifth coin route 32 and have been deemed C-type coins, and second retaining unit driving means that comprises a solenoid or the like that causes the second coin retaining lever 101 to revolve around its shaft 102 and is not shown in the drawings.

With regard to this second coin retaining means 100, in the initial state shown in FIG. 1, an arc-shaped proximal end portion 101*a* continuously receives force from the second retaining unit driving means comprising a solenoid or the like and not shown in the drawings which causes it to revolve counterclockwise around the shaft 102 and is then stopped from moving, and as a result, this proximal end portion 101*a* is caused to protrude into the interior of the fifth coin sorting route 32, thereby closing off the downstream end of the fifth coin sorting route 32, while the cylindrical distal end portion 101*b* is retracted from the interior of the fifth coin sorting route 32, thereby opening up the upstream end of the fifth coin sorting route 32, as shown in FIG. 8.

In this initial state, when a single C-type coin is guided into the fifth coin sorting route 32 as shown in FIGS. 6 and 8, the proximal end portion 101*a* of the coin retaining lever 101 retains the C-type coin by supporting the circumferential surface thereof, and when a plurality of (four) C-type coins are guided into the fifth coin sorting route 32 after this C-type coin has been retained, these four C-type coins are successively retained temporarily inside the fifth coin sorting route 32 by the proximal end portion 101*a*.

As shown in FIG. 6, because the fifth coin sorting route 32 is curved essentially in an S shape tracing the direction of coin movement in order to make it as long as possible, a total of four C-type coins can be retained temporarily inside the fifth coin sorting route 32.

Furthermore, in regard to the first coin distributing lever 130 and second coin distributing lever 150 located at the bottom ends of the first coin retaining means 60 and the second coin retaining means 100, respectively, as shown in FIGS. 7 and 8, the first coin distributing lever 130 is supported such that it can revolve around the shaft 131, and in the initial position, the first coin distributing lever 130 is stopped, by the first driving means comprising a solenoid or the like not shown in the drawings, at a position in which the coin return route 110 is closed off and the coin storage route 120 is opened up.

Moreover, as shown in FIGS. 7 and 8, the second coin distributing lever 150 is supported such that it can revolve around the shaft 151, and in the initial position, the second coin distributing lever 150 is stopped, by the second driving means comprising a solenoid or the like not shown in the drawings, at a position in which the cash box route 140 is closed off and the coin storage route 120 is opened up.

Figure 9:
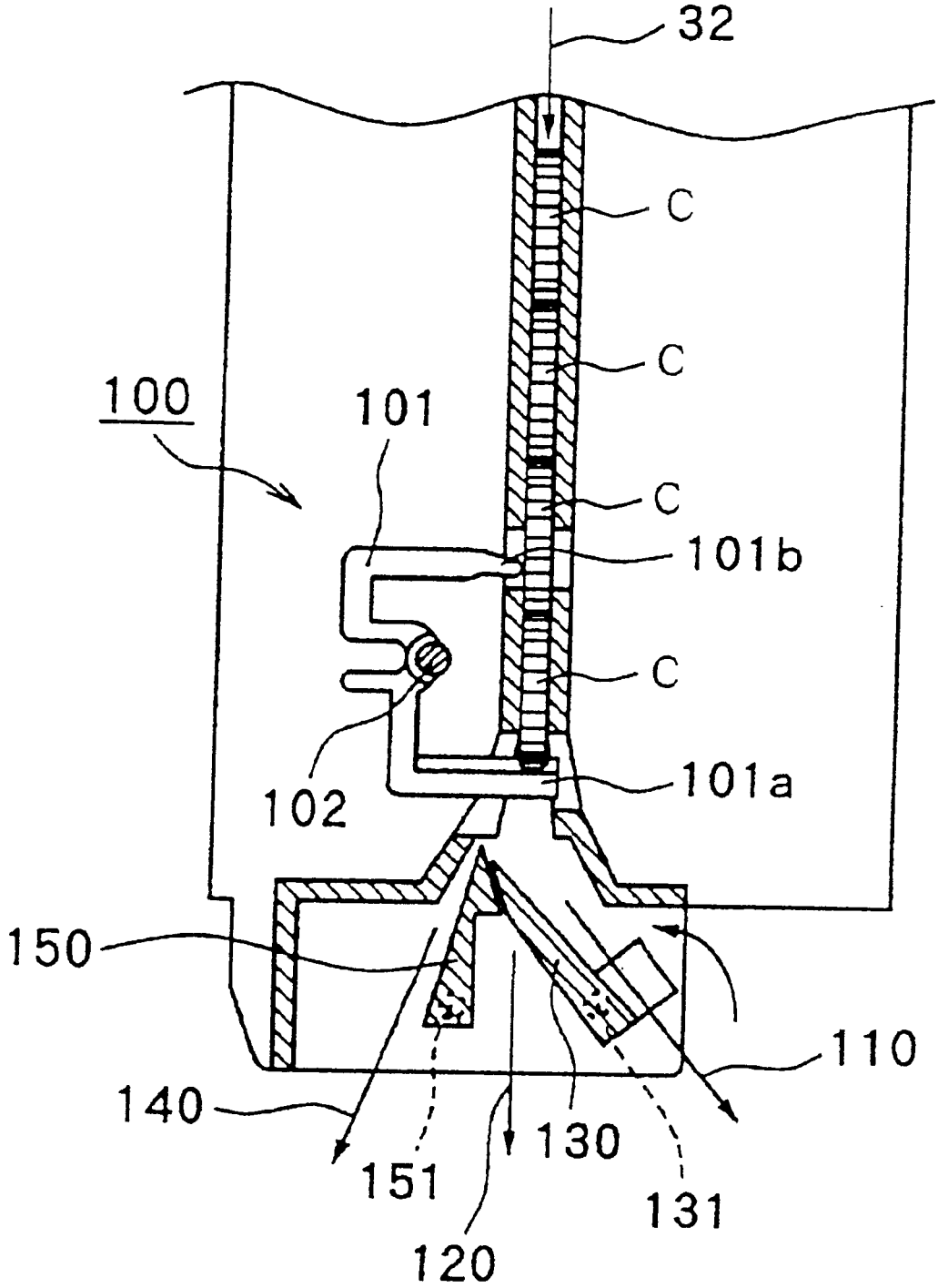
FIG. 9 is a schematic cross-section showing the operation of a second coin retaining means.
Figure 10:
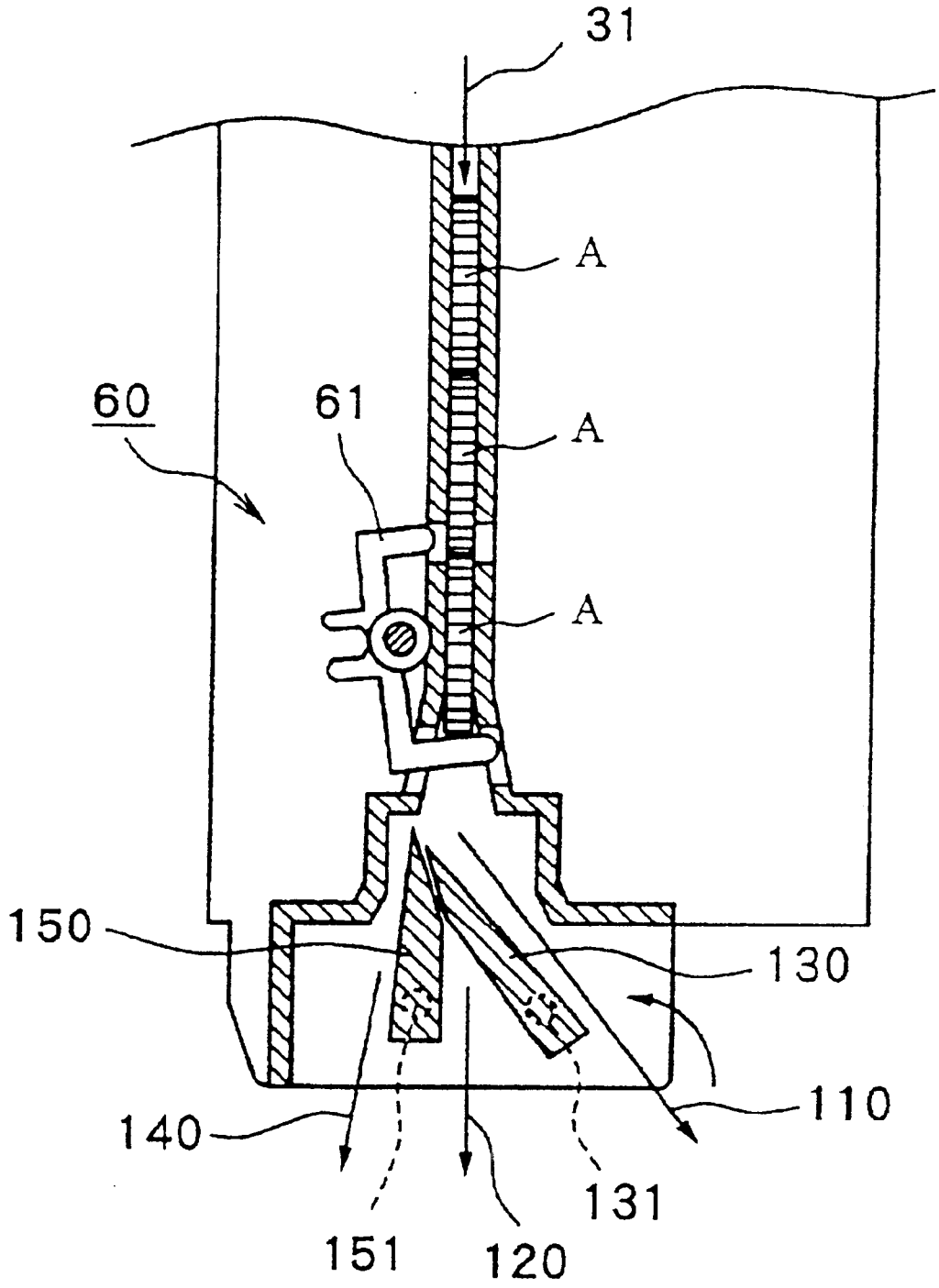
FIG. 10 is a schematic cross-section showing the operation of the first coin retaining means.

At the initial position shown in FIGS. 7 and 8, when the first driving means is driven based on driving signals from a control apparatus not shown in the drawings, the coin distributing lever 130 revolves in a counterclockwise direction around the shaft 131 in accordance with a prescribed angle of revolution, closing off the coin storage route 120 and opening up the coin return route 110, as shown in FIGS. 9 and 10.

Figure 11:
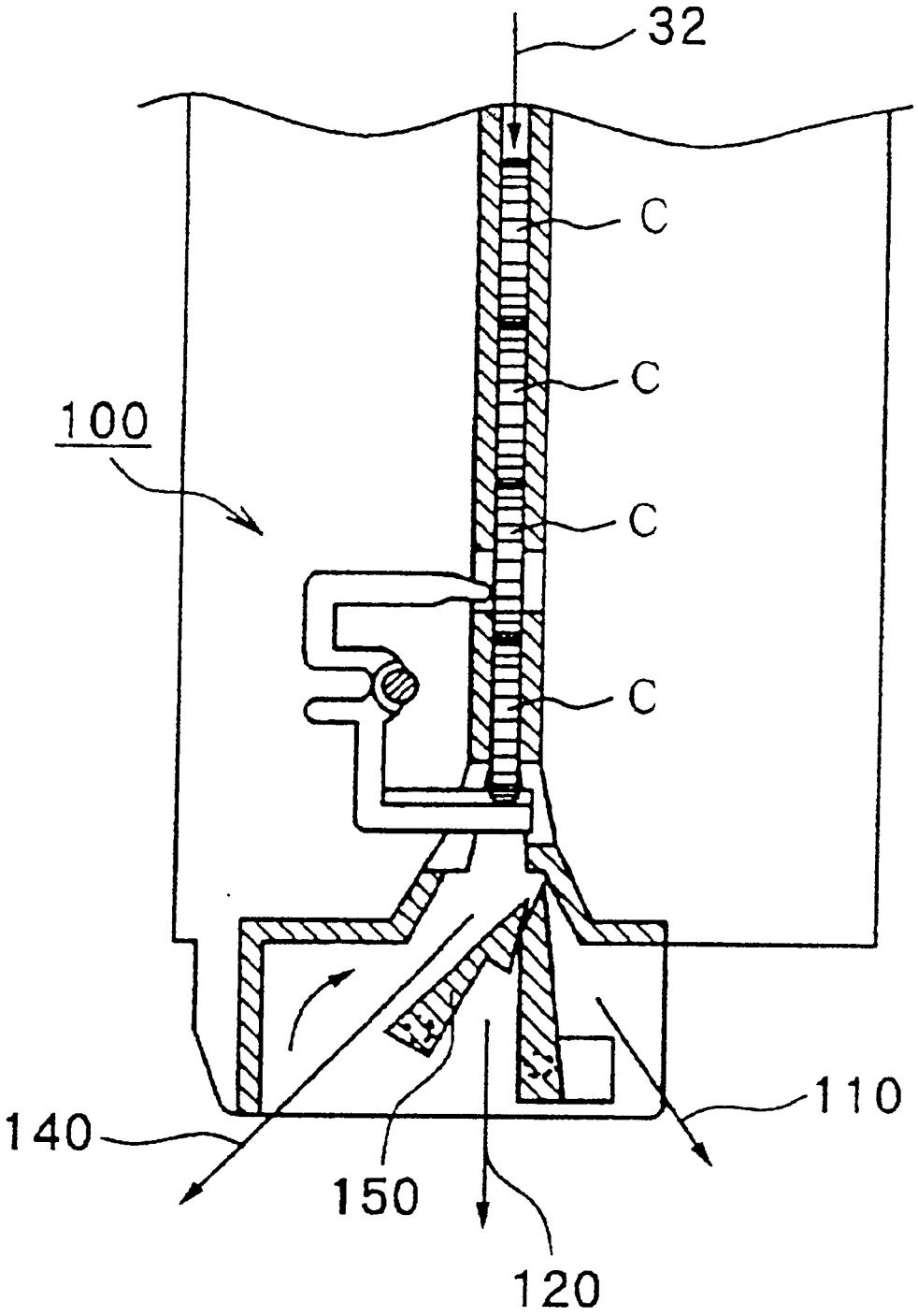
FIG. 11 is a schematic cross-section showing the operation of the second coin retaining means.
Figure 12:
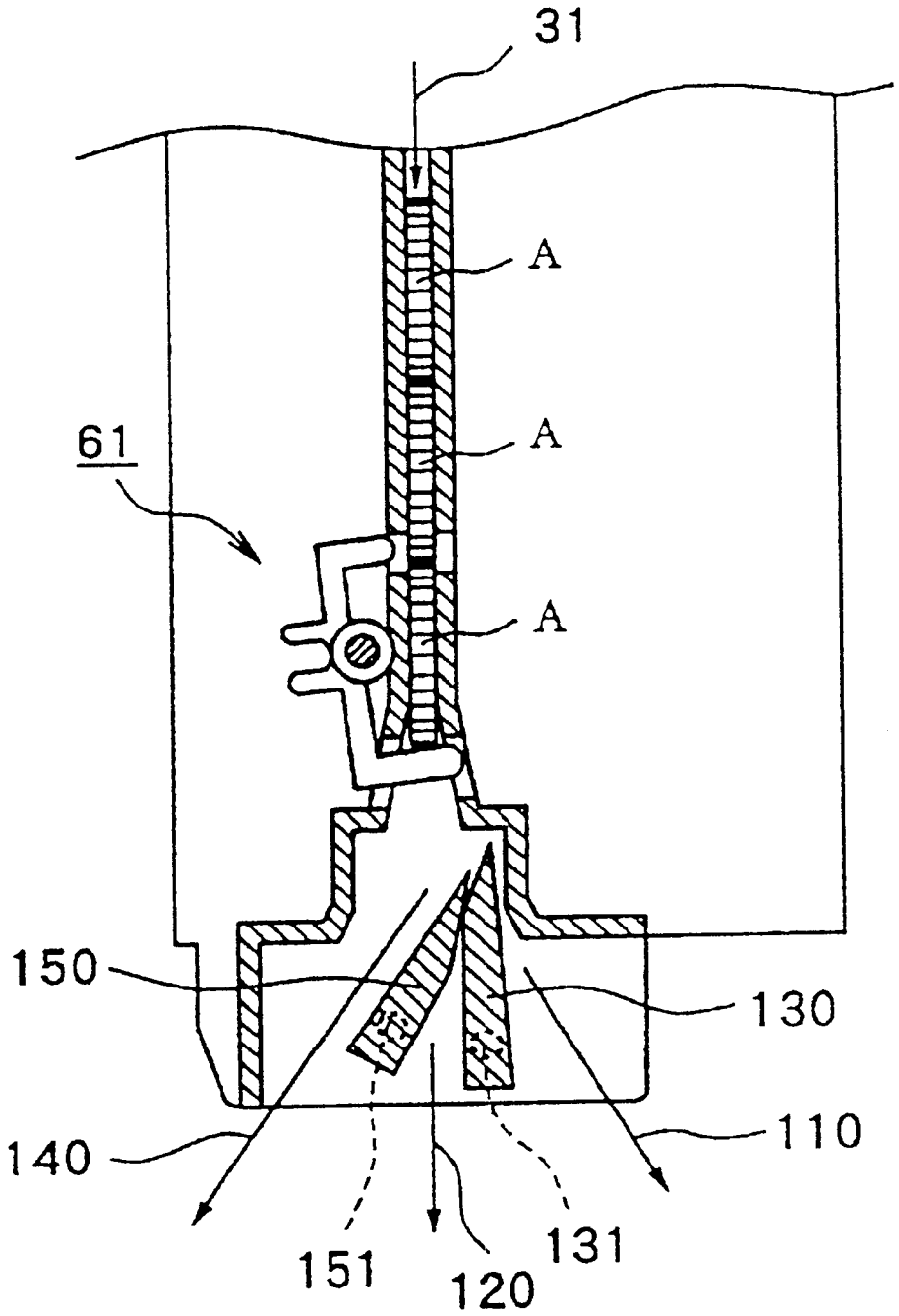
FIG. 12 is a schematic cross-section showing the operation of the first coin retaining means.

In addition, at the initial position shown in FIGS. 7 and 8, when the second driving means is driven based on driving signals from a control apparatus not shown in the drawings, the coin distributing lever 150 revolves in a clockwise direction around the shaft 151 in accordance with a prescribed angle of revolution, thereby closing off the coin storage route 120 and opening up the cash box route 140, as shown in FIGS. 11 and 12.

Figure 13:
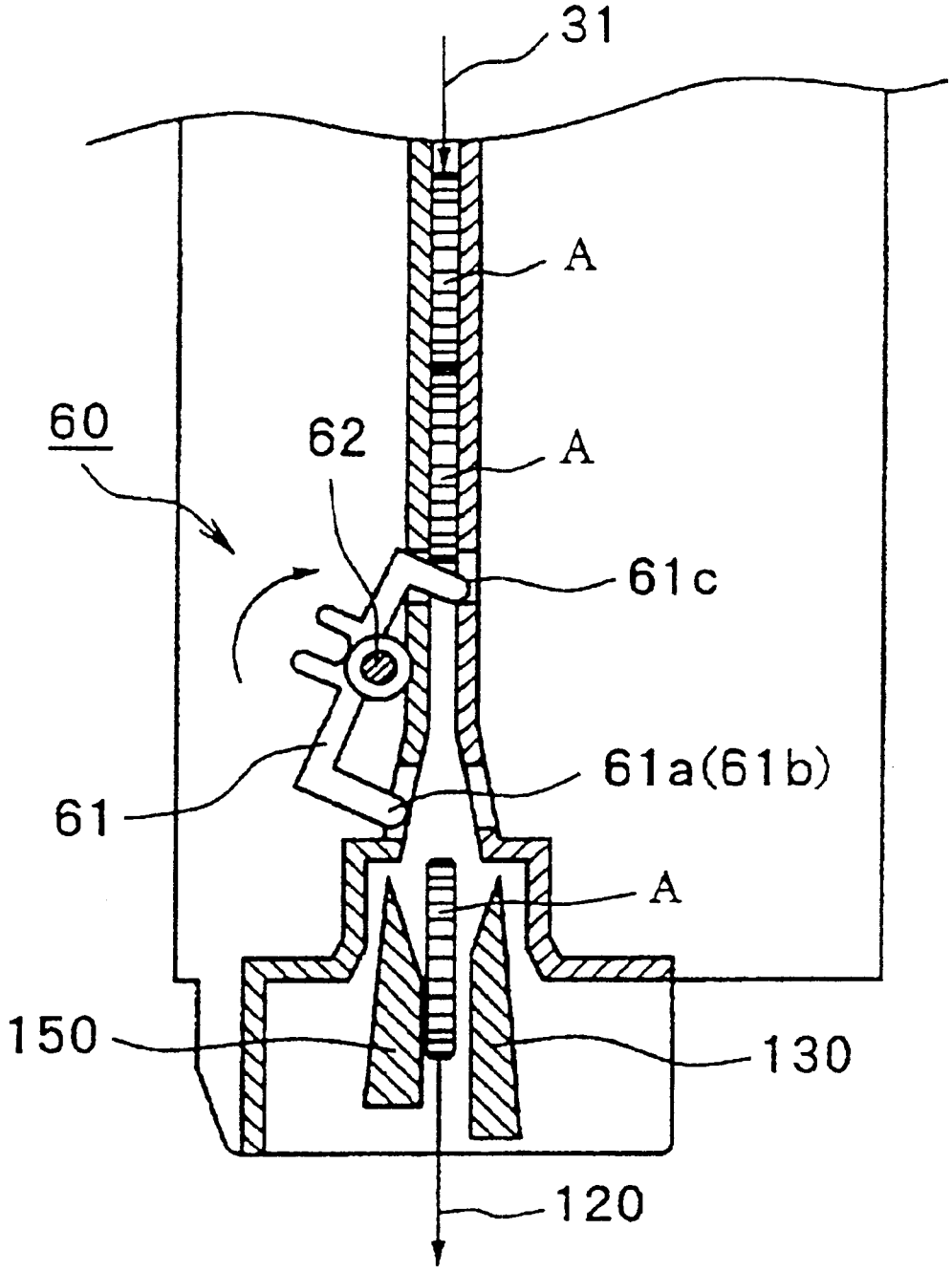
FIG. 13 is a schematic cross-section showing the operation of the first coin retaining means.

At the same time, with the first coin distributing lever 130 and the second coin distributing lever 150 at the initial positions shown in FIGS. 7 and 8 (i.e., the positions at which the coin storage route 120 is open), when the first coin retaining lever 61 shown in FIG. 7 revolves clockwise around the shaft 62 due to the first retaining unit driving means comprising a solenoid or the like that is not shown in the drawings based on driving signals from a control apparatus not shown in the drawings, the proximal end portions 61*a* and 61*b* retract from the fourth coin sorting route 31 as shown in FIG. 13, thereby opening up the downstream part of the fourth coin sorting route 31, and the distal end portion 61*c* protrudes into the fourth coin sorting route 31, thereby closing off the fourth coin sorting route 31.

When this occurs, the retaining of the A-type coin that was retained directly by the proximal end portions 61*a* and 61*b* of the first coin retaining lever 61 is cancelled, and because the circumferential surface of the subsequent A-type coin that is positioned directly following the A-type coin being directly retained by the proximal end portions 61*a* and 61*b* is supported and retained by the distal end portion 61*c*, only one A-type coin is guided into the coin storage route

120, whereupon it falls into the corresponding coin tube where it is accumulated and stored.

When the driving of the first coin retaining lever 61 shown in FIG. 13 is set to OFF based on driving signals from the control apparatus not shown in the drawings, the first coin retaining lever 61 revolves counterclockwise around the shaft 62, causing the proximal end portions 61*a* and 61*b* to protrude into the fourth coin sorting route 31 and thereby closing off the downstream part thereof, and the distal end portion 61*c* is returned to its initial state wherein it is retracted from the interior of the fourth coin sorting route 31.

Figure 14:
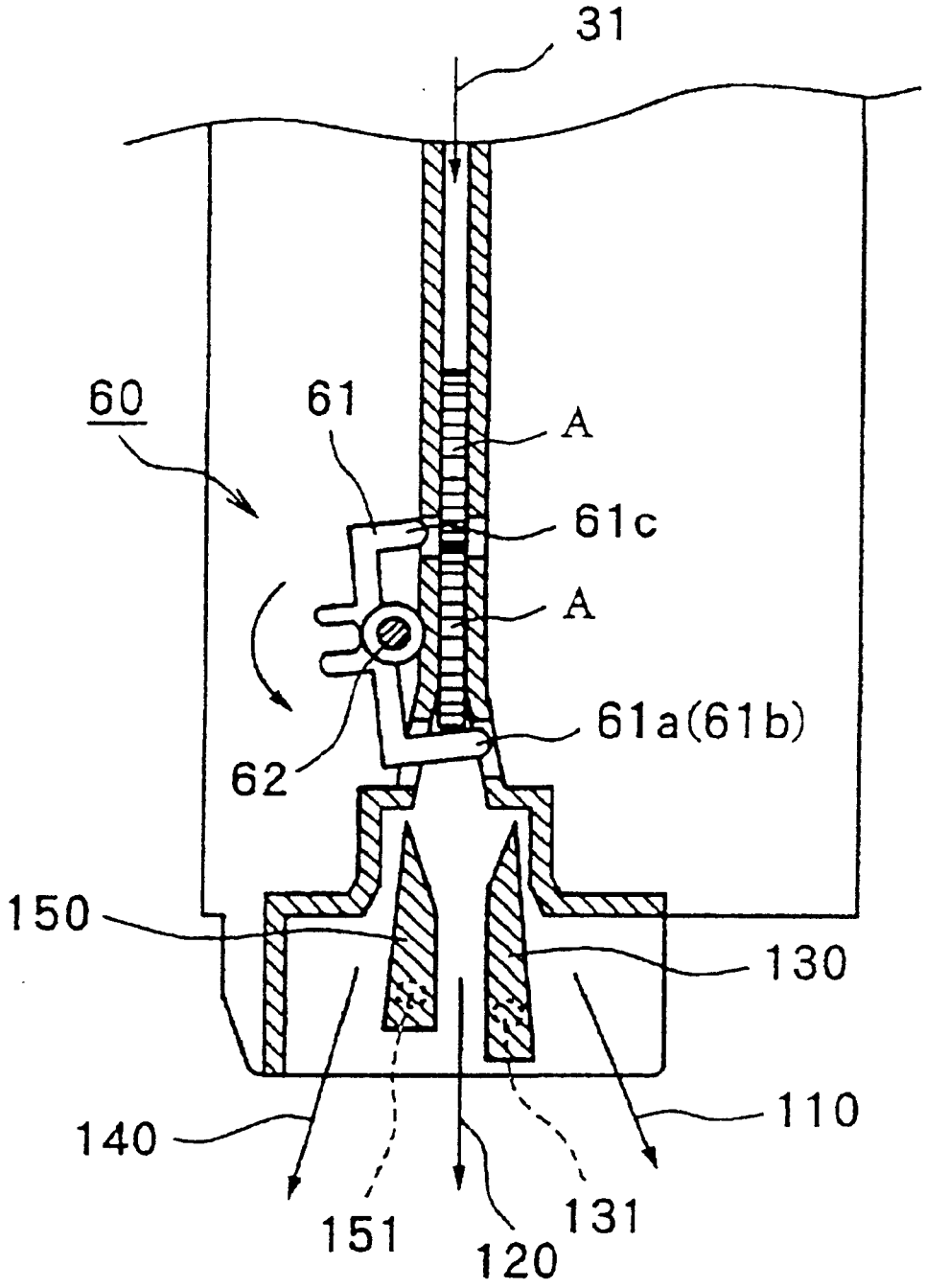
FIG. 14 is a schematic cross-section showing the operation of the first coin retaining means.

When this occurs, the temporary retaining of the A-type coins that had been temporarily stopped by the distal end portion 61*c* of the first coin retaining lever 61 is cancelled and the remaining A-type coins are guided downward in the fourth coin sorting route 31, the proximal end portions 61*a* and 61*b* support the A-type coin among the plurality of A-type coins guided downward in the fourth coin sorting route 31 that is farthest down, and the supported A-type coin and the A-type coin that is adjacent thereto on the upstream side are temporarily retained in the fourth coin sorting route 31, as shown in FIG. 14.

In other words, using the first coin retaining lever 61 of the first coin retaining means 60, the three A-type coins temporarily retained in the fourth coin sorting route 31 can be made to drop intermittently one coin at a time through the alternating presence of the proximal end portions 61*a* and 61*b* and the distal end portion 61*c* in the fourth coin sorting route 31.

Figure 15:
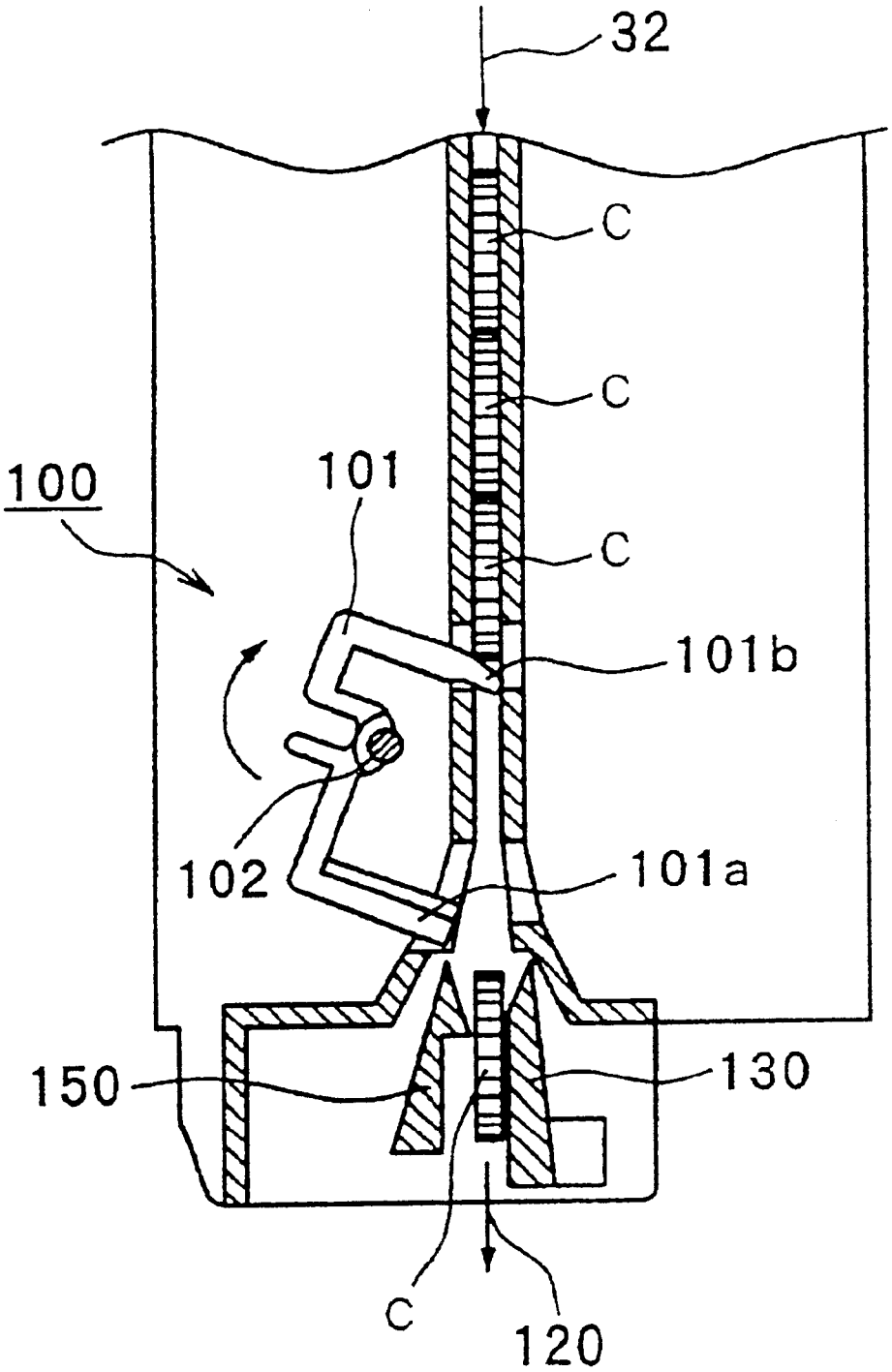
FIG. 15 is a schematic cross-section showing the operation of the second coin retaining means.

Similarly, with the first coin distributing lever 130 and the second coin distributing lever 150 at the initial positions shown in FIGS. 7 and 8 (i.e., the positions at which the coin storage route 120 is open), when the second coin retaining lever 101 shown in FIG. 8 revolves clockwise around the shaft 102 due to the second retaining unit driving means comprising a solenoid or the like that is not shown in the drawings based on driving signals from a control apparatus not shown in the drawings, the arc-shaped proximal end portion 101*a* retracts from the fifth coin sorting route 32 as shown in FIG. 15, thereby opening up the downstream part of the fifth coin sorting route 32, and the distal end portion 101*b* protrudes into the fifth coin sorting route 32, thereby closing off the fifth coin sorting route 32.

When this occurs, the retaining of the C-type coin that was retained directly by the proximal end portion 101*a* of the second coin retaining lever 101 is cancelled, and because the circumferential surface of the subsequent C-type coin that is positioned directly following the C-type coin being directly retained by the proximal end portion 101*a* is supported and retained by the distal end portion 101*b*, only one C-type coin is guided into the coin storage route 120, whereupon it falls into the corresponding coin tube where it is accumulated and stored.

When the driving of the second coin retaining lever 101 shown in FIG. 15 is set to OFF based on driving signals from the control apparatus not shown in the drawings, the second coin retaining lever 101 revolves counterclockwise around the shaft 102, causing the proximal end portion 101*a* to protrude into the fifth coin sorting route 32 and thereby closing off the downstream part thereof, and the distal end portion 101*b* is returned to its initial state wherein it is retracted from the interior of the fifth coin sorting route 32.

Figure 16:
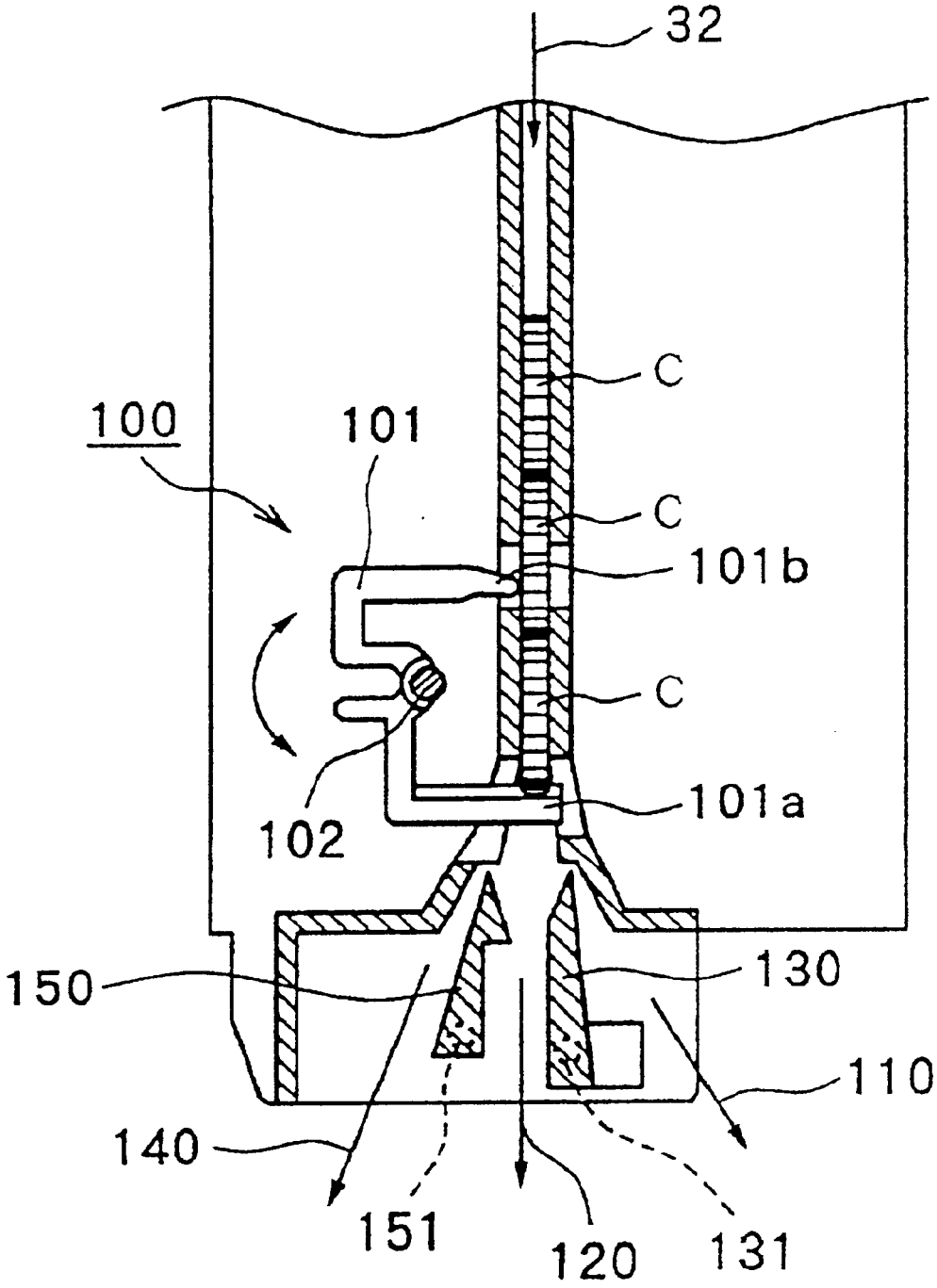
FIG. 16 is a schematic cross-section showing the operation of the second coin retaining means.

When this occurs, the temporary retaining of the C-type coins that had been temporarily stopped by the distal end portion 101*b* of the second coin retaining lever 101 is cancelled and the remaining C-type coins are guided downward in the fifth coin sorting route 32, the proximal end portion 101*a* supports the C-type coin among the plurality of C-type coins guided downward in the fifth coin sorting route 32 that is farthest down, and the supported C-type coin and the C-type coins that are adjacent thereto on the upstream side are temporarily retained in the fifth coin sorting route 32, as shown in FIG. 16.

In other words, using the second coin retaining lever 101 of the second coin retaining means 100, the four C-type coins temporarily retained in the fifth coin sorting route 32 can be made to drop intermittently one coin at a time through the alternating presence of the proximal end portion 101*a* and the distal end portion 101*b* in the fifth coin sorting route 32.

The operation of the coin assorter 1 described above will now be explained.

As shown in FIG. 2, if it is determined based on the detection signal from the coin discrimination sensor 11 that a false coin G inserted in the coin insertion inlet 3 is false, the genuine/false coin distributing lever 12 opens the false coin ejection route 13 based on the corresponding determination signal. When this occurs, the false coin G that rolls in from the coin discrimination route 10 is guided to the false coin ejection route 13 by the genuine/false coin distributing lever 12, and is returned to the coin return outlet not shown in the drawings via the false coin ejection chute 21 that connects to the false coin ejection route 13.

Figure 17:
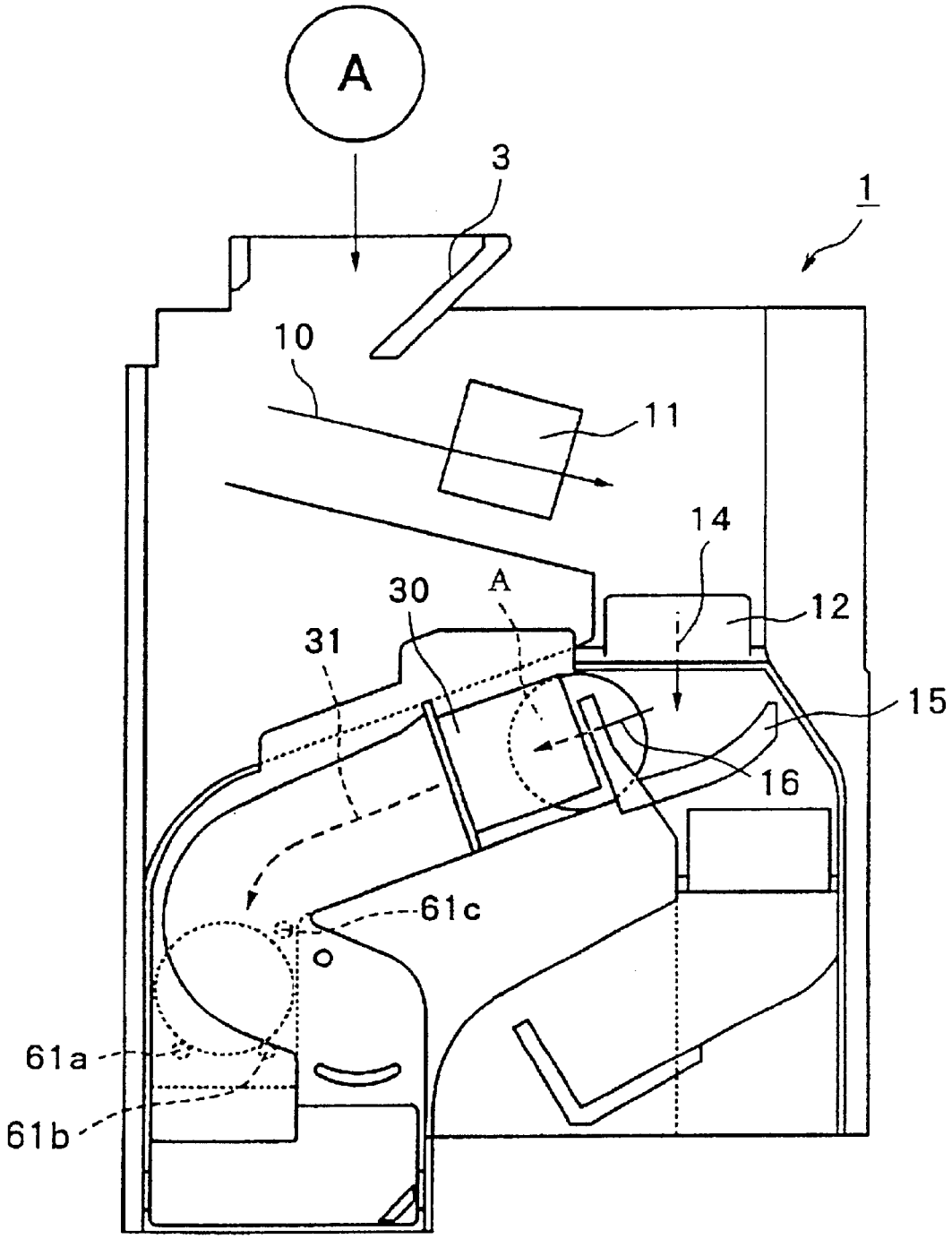
FIG. 17 is a schematic front elevation of the coin assorter showing the temporary retaining of an A-type coin.

Next, as shown in FIG. 17, when a coin inserted in the coin insertion inlet 3 is determined based on the detection signal from the coin discrimination sensor 11 to be a genuine A-type coin, the control apparatus not shown in the drawings operates the genuine/false coin distributing lever 12 and opens the upstream part of the first coin sorting route 14 based on the determination signal. At the same time, the upstream part of the second coin sorting route 16 is opened by the first denomination distributing lever 15, and the fourth coin sorting route 31 is opened by the second denomination distributing lever 30.

When the control apparatus not shown in the drawings determines based on the detection signal from the coin discrimination sensor 11 that the inserted coin is a genuine A-type coin, the first coin retaining lever 61 is driven by the first retaining unit driving means not shown in the drawings, whereby the proximal end portions 61*a* and 61*b* protrude into the fourth coin sorting route 31 and close off the downstream part thereof, and the distal end portion 61*c* is retracted from the coin sorting route 31, as shown in FIG. 7.

As a result, as shown in FIG. 17, after rolling down the coin discrimination route 10, the A-type coin inserted in the coin insertion inlet 3 is guided to the first coin sorting route 14 by the genuine/false coin distributing lever 12 and is then guided to the second coin sorting route 16 by the first coin distributing lever 15.

The A-type coin is then guided to the fourth coin sorting route 31 by the second denomination distributing lever 30 and is temporarily retained at the downstream end of the fourth coin sorting route 31 by the proximal end portions 61*a* and 61*b* of the first coin retaining lever 61.

Next, where additional coins inserted in the coin insertion inlet 3 are determined by the coin discrimination sensor 11 to be A-type coins and are guided to the fourth coin sorting route 31, these A-type coins are successively retained temporarily above the A-type coin that is being directly supported by the proximal end portions 61*a* and 61*b* of the first coin retaining lever 61, as shown in FIG. 5.

Furthermore, in accordance with the length of the fourth coin sorting route 31, a maximum of three A-type coins can be retained temporarily inside the fourth coin sorting route 31, including the coin directly supported by the proximal end portions 61*a* and 61*b*, as shown in FIG. 5.

Next, if the coin return lever is operated without a product purchase in the automatic vending machine in which the coin assorter 1 is installed while these A-type coins are being temporarily retained therein, the control apparatus not shown in the drawings first drives the first coin distributing lever 130 to rotate counterclockwise, thereby closing off the coin storage route 120 and opening up the coin return route 110, as shown in FIG. 10, based on operation signals from the coin return lever. The control apparatus not shown in the drawings then drives the first coin retaining lever 61 via the first retaining unit driving means not shown in the drawings, thereby causing the proximal end portions 61*a* and 61*b* to retract from the fourth coin sorting route 31, opening up the downstream area thereof, and causing the distal end portion 61*c* to protrude into the fourth coin sorting route 31.

Figure 18:
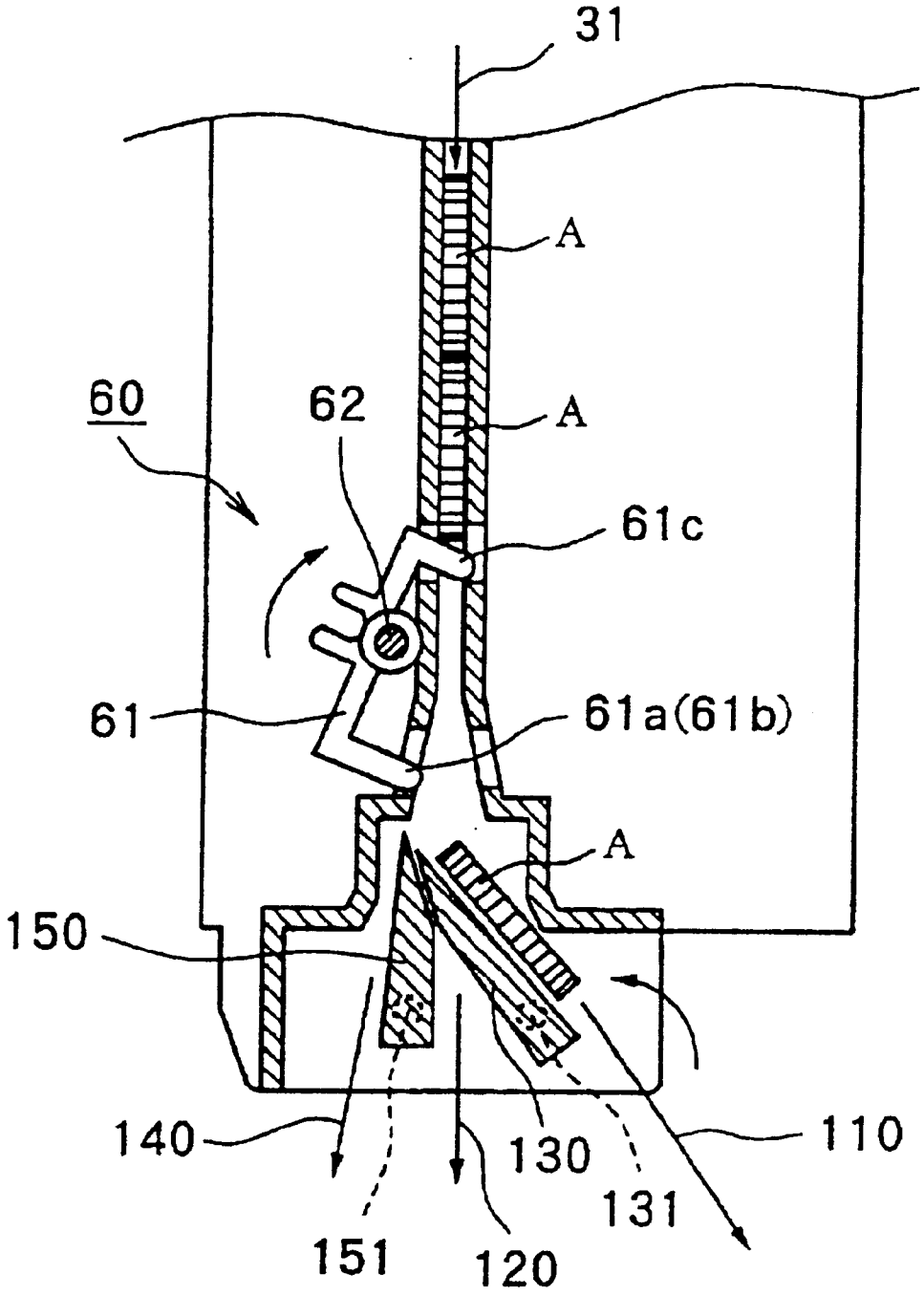
FIG. 18 is a schematic cross-section showing the process by which the temporary retaining of the A-type coin is cancelled.

When this is done, only one of the A-type coins retained by the proximal end portions 61*a* and 61*b* of the first coin retaining lever 61 is guided to the coin return route 110, and this coin is then returned to the coin return outlet that connects to this coin return route 110 and is not shown in the drawings, as shown in FIG. 18.

In the same manner as described above, the remaining A-type coins are intermittently and successively returned to the coin return outlet one coin at a time through the alternating presence of the proximal end portions 61*a* and 61*b* and the distal end portion 61*c* of the first coin retaining lever 61 in the fourth coin sorting route 31.

Therefore, when the coin return lever is operated without a product purchase, this same coin return process is performed for the number of times corresponding to the number of retained coins, and all of the retained A-type coins to be intermittently dropped are returned to the coin return outlet.

Consequently, in the coin assorter 1, where the coin return lever is operated and A-type coins are to be returned without a product purchase, because the coins actually inserted, i.e., the temporarily retained A-type coins, are the ones paid out to the coin return outlet, even if A-type coins (false coin) realistic enough to be deemed genuine by the coin assorter 1 are inserted, because the inserted A-type coins (i.e., the false coin) themselves are paid out to the coin return outlet, the occurrence of the coin switching phenomenon can be eliminated to the maximum possible extent.

The case in which a product is purchased while A-type coins are being temporarily retained will now be explained in detail.

When a product is purchased, the control apparatus not shown in the drawings first positions the first coin distributing lever 130 in the initial position based on product purchase signals, thereby opening up the coin storage route 120 and closing off the coin return route 110, as shown in FIG. 7. The control apparatus not shown in the drawings then drives the first coin retaining lever 61 via the first retaining unit driving means not shown in the drawings, whereby the proximal end portions 61*a* and 61*b* are retracted from the fourth coin sorting route 31, opening up the downstream part thereof, and the distal end portion 61*c* is caused to protrude into the fourth coin sorting route 31.

When this occurs, only one of the A-type coins being supported by the proximal end portions 61*a* and 61*b* of the first coin retaining lever 61 is guided into the coin storage route 120, whereupon such coin is dropped into and stored in the coin tube that corresponds to A-type coins within the coin storage unit that is not shown in the drawings but is positioned below the coin storage route 120, as shown in FIG. 13.

In the same manner as described above, the remaining A-type coins are intermittently and successively dropped into, accumulated and stored in the corresponding coin tube one coin at a time through the alternating presence of the proximal end portions 61*a* and 61*b* and the distal end portion 61*c* of the first coin retaining lever 61 in the fourth coin sorting route 31, and this process is performed for the number of times corresponding to the number of retained A-type coins.

Where, during the time that an A-type coin is being stored inside the corresponding coin tube, it is detected by the filled-up sensor mounted inside that coin tube that a certain number of A-type coins have been stored therein, the control apparatus rotates the second coin distributing lever 150 clockwise based on the detection signal, thereby closing off the coin storage route 120 and opening up the cash box route 140, as shown in FIG. 12.

Figure 19:
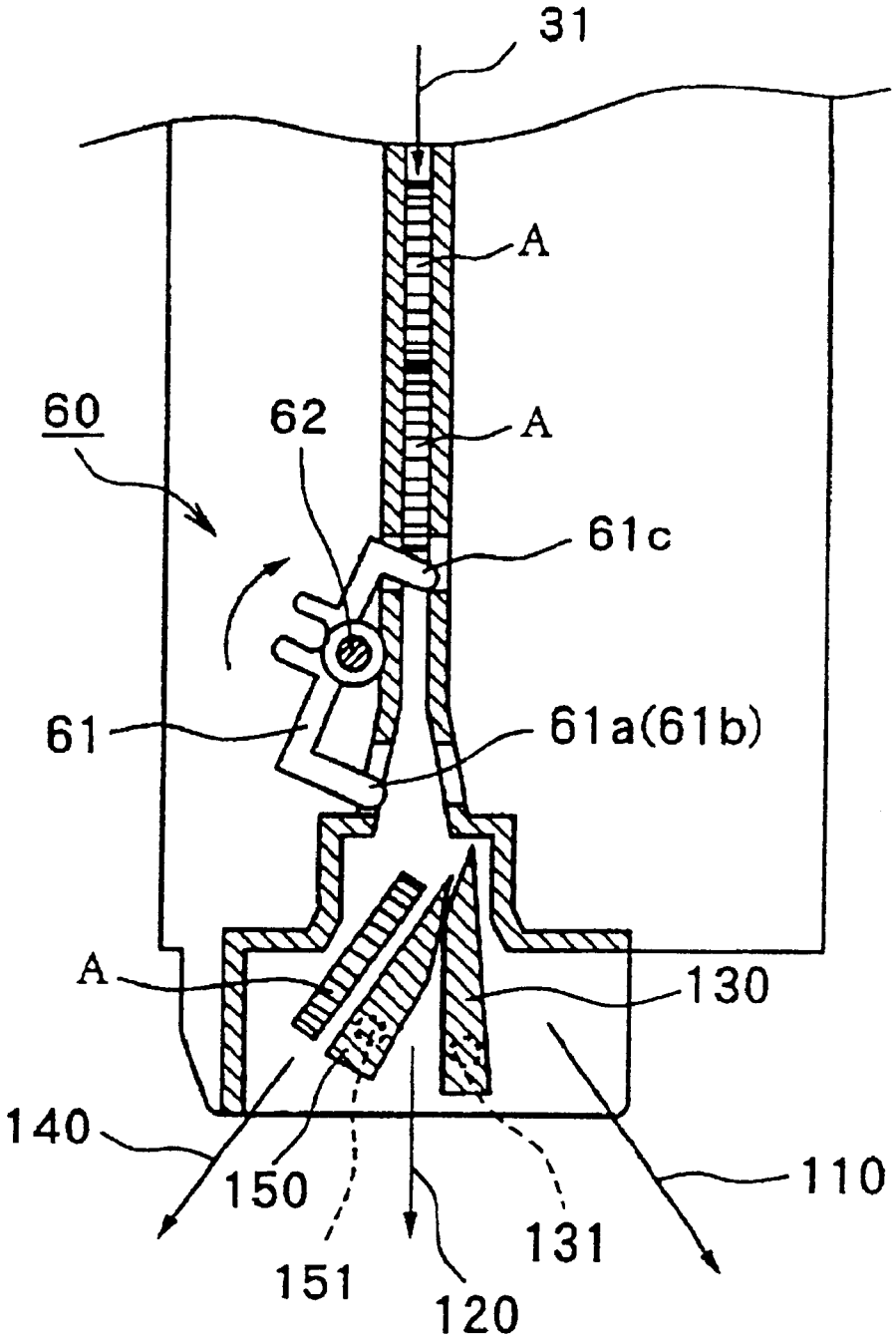
FIG. 19 is a schematic cross-section showing the process by which the temporary retaining of the A-type coin is cancelled.

As a result, A-type coins that are subsequently dropped are stored to the extent possible in the cash box not shown in the drawings one coin at a time, and A-type coins exceeding the tube capacity are not stored in the corresponding A-type coin tube, as shown in FIG. 19.

Figure 20:
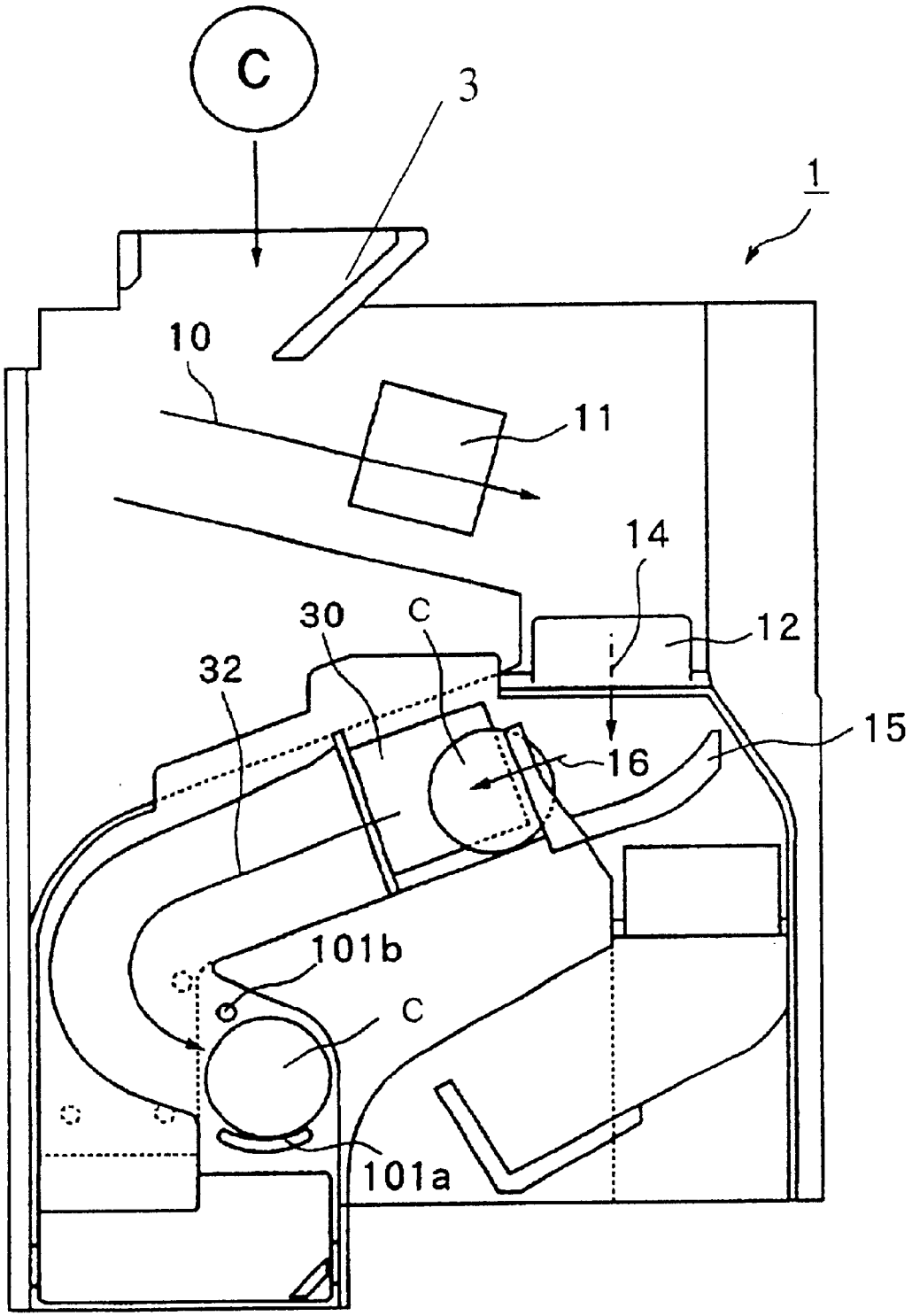
FIG. 20 is a schematic front elevation of the coin assorter showing the temporary retaining of a C-type coin.

Next, as shown in FIG. 20, when a coin inserted in the coin insertion inlet 3 is determined based on the detection signal from the coin discrimination sensor 11 to be a C-type coin, the control apparatus not shown in the drawings operates the genuine/false coin distributing lever 12 and opens the upstream part of the first coin sorting route 14 based on the determination signal. At the same time, the upstream part of the second coin sorting route 16 is opened by the first denomination distributing lever 15. Furthermore, the second denomination distributing lever 30 is operated to close off the fourth coin sorting route 31 and open up the fifth coin sorting route 32.

When the control apparatus not shown in the drawings determines based on the detection signal from the coin discrimination sensor 11 that the inserted coin is a genuine C-type coin, the second coin retaining lever 101 is driven by the second retaining unit driving means not shown in the drawings, whereby the proximal end portion 101*a* protrudes into the fifth coin sorting route 32 and closes off the downstream part thereof, and the distal end portion 101*b* is retracted from the coin sorting route 32, as shown in FIG. 8.

As a result, as shown in FIG. 20, after rolling down the coin discrimination route 10, the C-type coin inserted in the coin insertion inlet 3 is guided to the first coin sorting route 14 by the genuine/false coin distributing lever 12 and is then guided to the second coin sorting route 16 by the first coin distributing lever 15.

The C-type coin is then guided to the fifth coin sorting route 32 by the second denomination distributing lever 30 and is temporarily retained at the downstream end of the fifth coin sorting route 32 by the proximal end portion 101*a* of the second coin retaining lever 101.

Next, where additional coins inserted in the coin insertion inlet 3 are determined by the coin discrimination sensor 11 to be C-type coins and are guided to the fifth coin sorting route 32, these C-type coins are successively retained temporarily above the C-type coin that is being directly supported by the proximal end portion 101*a* of the second coin retaining lever 101, as shown in FIG. 8.

Furthermore, because the fifth coin sorting route 32 is curved essentially in an S shape tracing the direction of coin movement and the length of the route is set to be long, a maximum of four C-type coins can be retained temporarily inside the fifth coin sorting route 32, as shown in FIG. 6.

Next, if the coin return lever is operated without a product purchase in the automatic vending machine in which the coin assorter 1 is installed while these C-type coins are being temporarily retained therein, the control apparatus not shown in the drawings first drives the first coin distributing lever 130 to rotate counterclockwise, thereby closing off the coin storage route 120 and opening up the coin return route 110, as shown in FIG. 9, based on operation signals from the coin return lever. The control apparatus then drives the second coin retaining lever 101 via the second retaining unit driving means not shown in the drawings, thereby causing the proximal end portion 101*a* to retract from the fifth coin sorting route 32, opening up the downstream area thereof, and causing the distal end portion 101*b* to protrude into the fifth coin sorting route 32.

Figure 21:
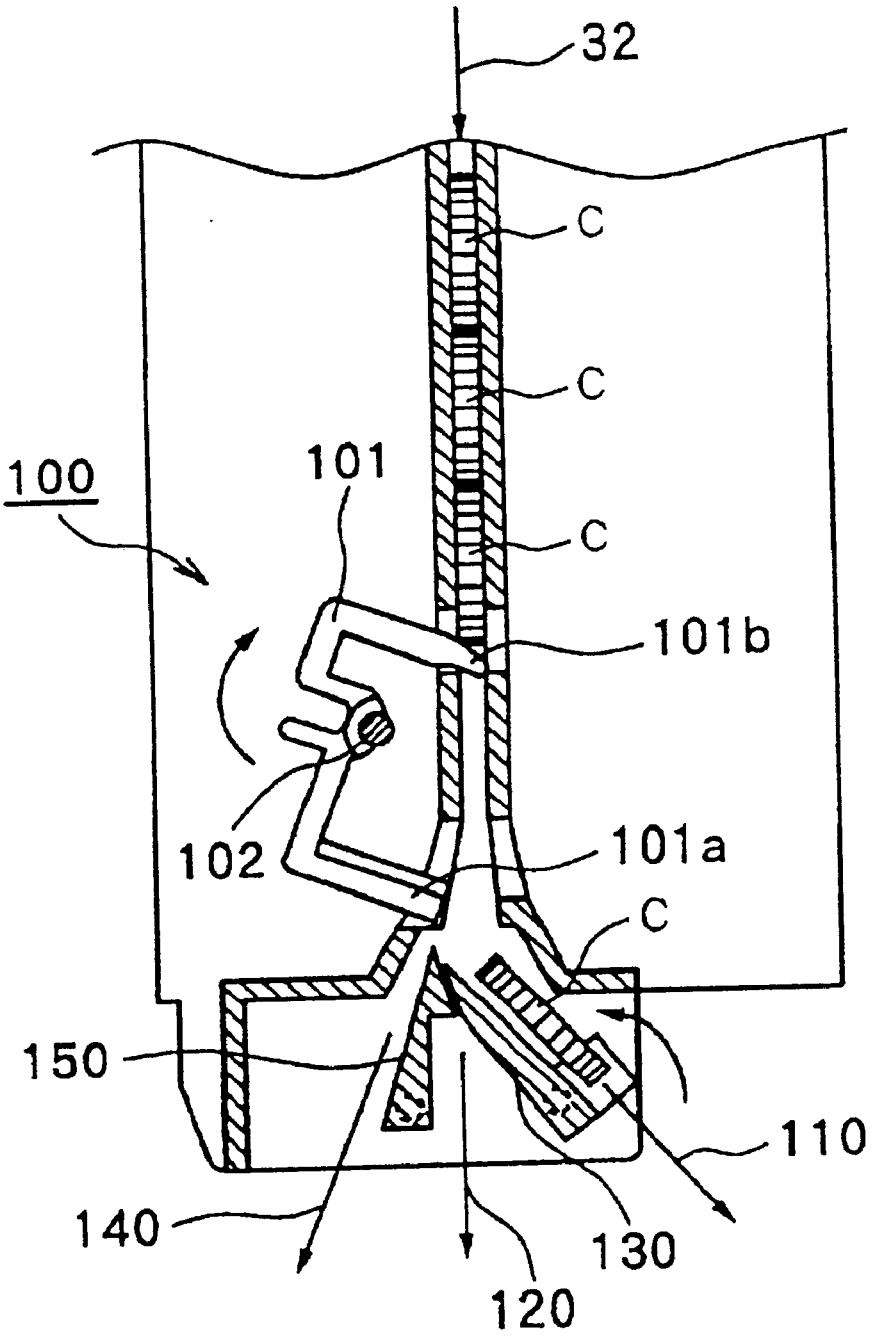
FIG. 21 is a schematic cross-section showing the process by which the temporary retaining of the C-type coin is cancelled.

When this is done, only one of the C-type coins retained by the proximal end portion 101*a* of the second coin retaining lever 101 is guided to the coin return route 110, and this coin is then returned to the coin return outlet that connects to this coin return route 110 and is not shown in the drawings, as shown in FIG. 21.

In the same manner as described above, the remaining C-type coins are intermittently and successively returned to the coin return outlet one coin at a time through the alternating presence of the proximal end portion 101*a* and the distal end portion 101*b* of the second coin retaining lever 101 in the fifth coin sorting route 32.

Therefore, when the coin return lever is operated without a product purchase, this same coin return process is performed for the number of times corresponding to the number of retained coins, and all of the retained C-type coins to be intermittently dropped are returned to the coin return outlet.

Consequently, in the coin assorter 1, where the coin return lever is operated and C-type coins are to be returned without a product purchase, because the coins actually inserted, i.e., the temporarily retained C-type coins, are the ones paid out to the coin return outlet, even if C-type coins (false coin) realistic enough to be deemed genuine are inserted, because the inserted C-type coins (i.e., the false coin) themselves are paid out to the coin return outlet, the occurrence of the coin switching phenomenon can be eliminated to the maximum possible extent.

The case in which a product is purchased while C-type coins are being temporarily retained will now be explained in detail.

When a product is purchased, the control apparatus not shown in the drawings first positions the first coin distributing lever 130 in the initial position based on product purchase signals, thereby opening up the coin storage route 120 and closing off the coin return route 110, as shown in FIG. 8. The control apparatus not shown in the drawings then drives the second coin retaining lever 101 via the second retaining unit driving means not shown in the drawings, whereby the proximal end portion 101*a* is retracted from the fifth coin sorting route 32, opening up the downstream part thereof, and the distal end portion 101*b* is caused to protrude into the fifth coin sorting route 32.

When this occurs, only one of the C-type coins being supported by the proximal end portion 101*a* of the second coin retaining lever 101 is guided into the coin storage route 120, whereupon the coin is dropped into and stored in the coin tube that corresponds to C-type coins within the coin storage unit that is not shown in the drawings but is positioned below, as shown in FIG. 15.

In the same manner as described above, the remaining C-type coins are intermittently and successively dropped into, accumulated and stored in the corresponding coin tube one coin at a time through the alternating presence of the proximal end portion 101*a* and the distal end portion 101*b* of the second coin retaining lever 101 in the fifth coin sorting route 32, and this process is performed for the number of times equal to the number of retained C-type coins.

Where, during the time that a C-type coin is being stored inside the corresponding coin tube, it is detected by the filled-up sensor mounted inside that coin tube that a certain number of C-type coins are being stored therein, the control apparatus rotates the second coin distributing lever 150 clockwise based on the detection signal, thereby closing off the coin storage route 120 and opening up the cash box route 140, as shown in FIG. 11.

Figure 22:
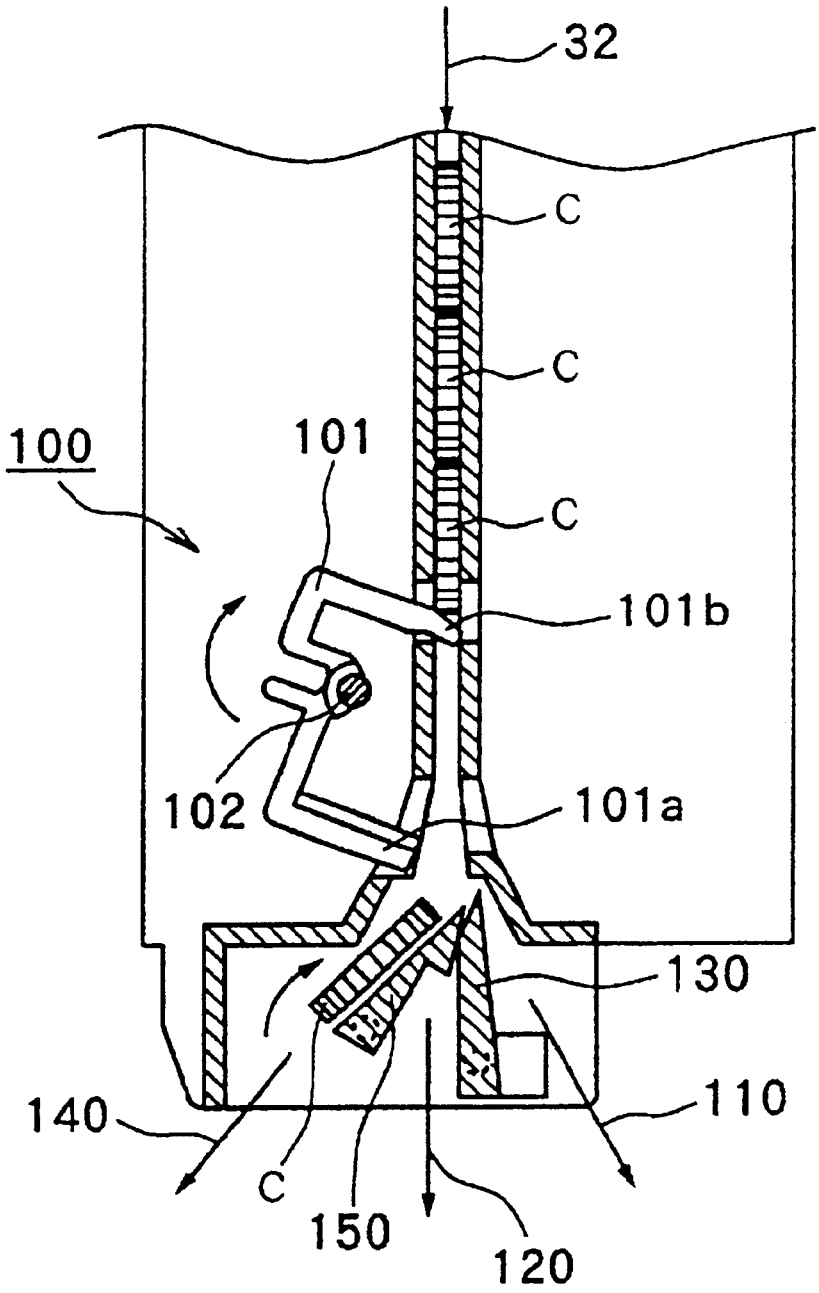
FIG. 22 is a schematic cross-section showing the process by which the temporary retaining of the C-type coin is cancelled.

As a result, C-type coins that are subsequently dropped are stored to the extent possible in the cash box not shown in the drawings one coin at a time, and C-type coins exceeding the tube capacity are not stored in the corresponding C-type coin tube, as shown in FIG. 22.

The situation in which both A-type coins and C-type coins are inserted in the coin insertion inlet 3 will now be explained in detail.

Figure 23:
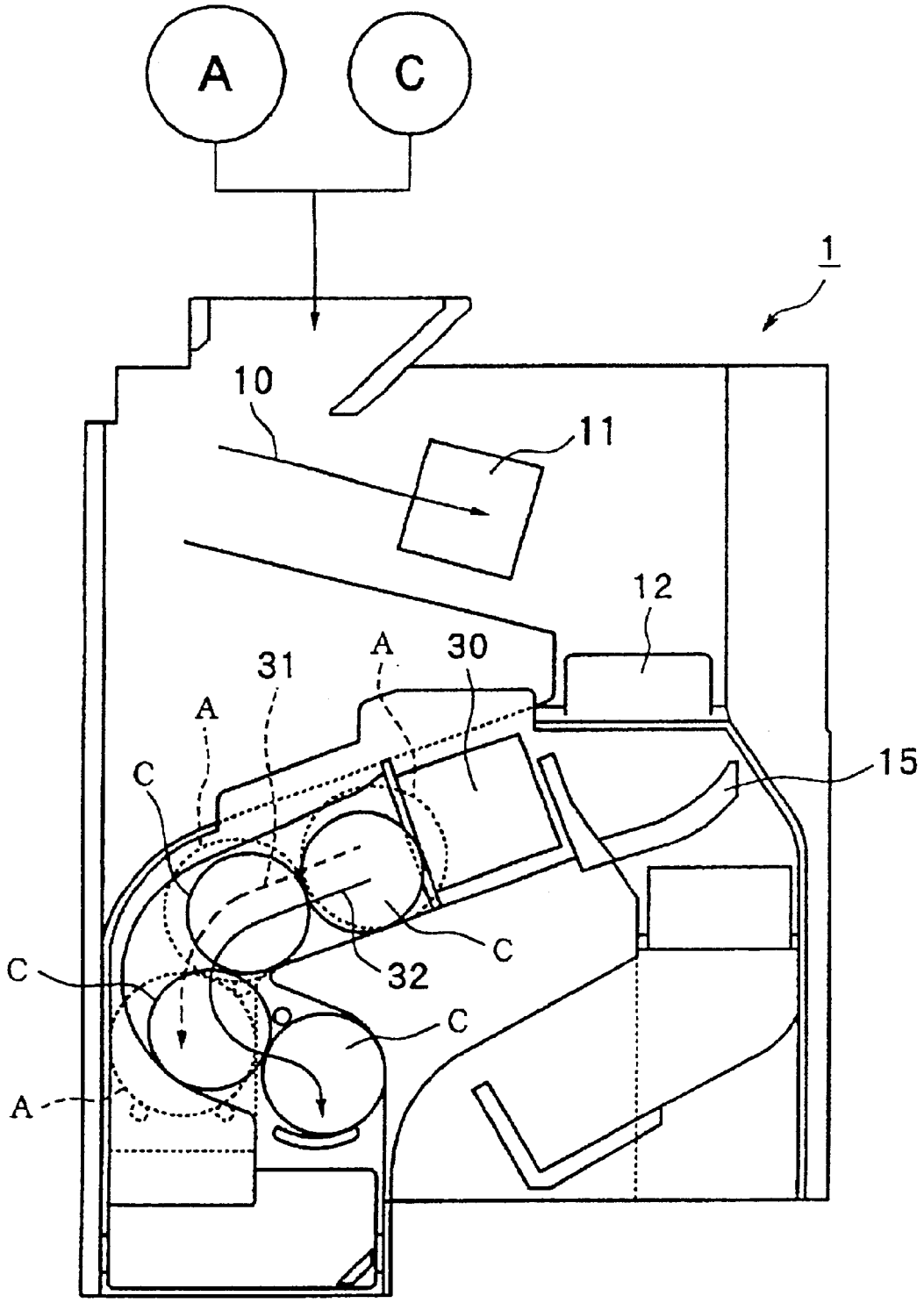
FIG. 23 is a schematic front elevation of the coin assorter showing the temporary retaining of the A-type coin and the C-type coin.

As shown in FIG. 23, when it is determined that an inserted coin is an A-type coin or a C-type coin based on the detection signal from the coin discrimination sensor 11, the A-type coins and the C-type coins are temporarily retained in the corresponding fourth coin sorting route 31 or fifth coin sorting route 32, based on the operation of the corresponding denomination distributing levers described above.

If the coin return lever is operated without a product purchase while these A-type coins and C-type coins are being temporarily retained, the control apparatus not shown in the drawings drives the first coin distributing lever 130 to rotate counterclockwise as shown in FIGS. 9 and 10 based on the operation signal from the coin return lever, thereby closing off the coin storage route 120 and opening up the coin return route 110.

The control apparatus then simultaneously drives the first coin retaining lever 61 and the second coin retaining lever 101 shown in FIGS. 9 and 10 in an intermittent fashion, whereby the A-type coins retained in the fourth sorting route 31 and the C-type coins retained in the fifth sorting route 32 are simultaneously returned to the coin return outlet not shown in the drawings via the coin return route 110, as shown in FIGS. 18 and 21.

The situation in which a product is purchased while A-type coins and C-type coins are being retained will now be described in detail.

When a product is purchased, the control apparatus not shown in the drawings first positions the first coin distributing lever 130 in the initial position based on product purchase signals, thereby opening up the coin storage route 120 and closing off the coin return route 110, as shown in FIGS. 7 and 8.

The control apparatus not shown in the drawings then intermittently guides either the A-type coins or the C-type coins (for example, the A-type coins only) to the coin storage route 120 or the cash box route 140 one at a time using the same operation as that described above, whereby the coins of only one of the denominations are accumulated and stored in the corresponding coin tube. In case that coin tube is full, the coins of that denomination are guided to the cash box.

After the coins of only one of the denominations are accumulated and stored in the corresponding coin tube, or if that coin tube is full, are guided to the cash box, the coins of the other denomination (for example, the C-type coins only) are guided to the coin storage route 120 or the cash box route 140 one at a time using the same operation as that described above, whereby the coins of only the other type are accumulated and stored in the corresponding coin tube, or if that coin tube is full, the coins of that denomination are guided to the cash box.

While both A-type coins and C-type coins are being temporarily retained, if the destinations to which the two denominations are to be guided are the same (for example, where both the A-type coins and the C-type coins are to be stored in the corresponding coin tubes, or where both the A-type coins and the C-type coins are to be guided to the cash box), the first coin retaining lever 61 and the second coin retaining lever 101 may be driven simultaneously in an intermittent fashion such that the A-type coins and C-type coins are guided simultaneously to the corresponding coin tubes, or are guided simultaneously to the cash box.

Figure 24:
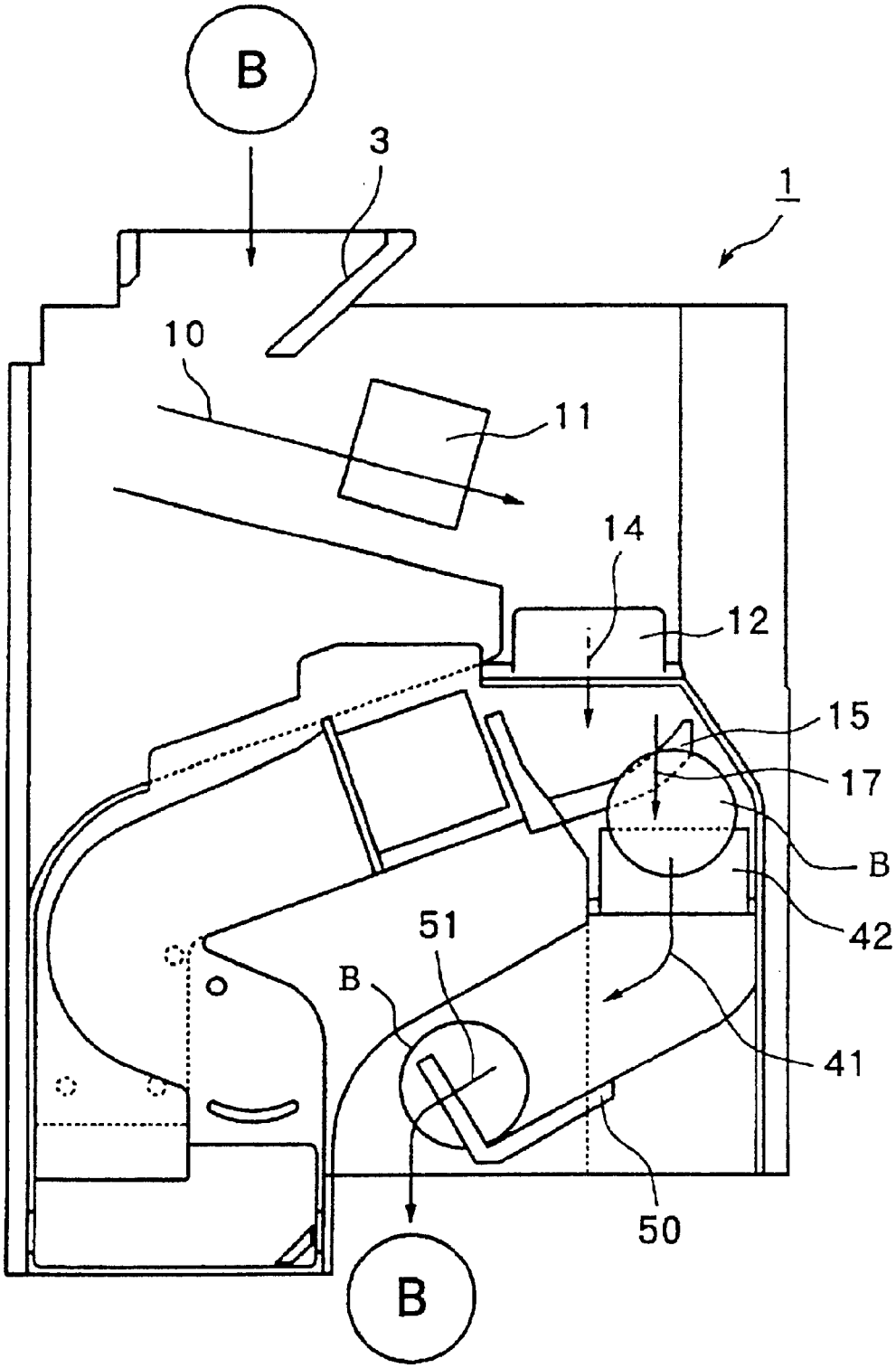
FIG. 24 is a schematic front elevation of the coin assorter showing the processing of a B-type coin.

If it is determined based on the detection signal from the coin discrimination sensor 11 that the coin inserted in the coin insertion inlet 3 is a B-type coin, the control apparatus not shown in the drawings operates the genuine/false coin distributing lever 12 to open the upstream part of the first coin sorting route 14, as well as the first denomination distributing lever 15 to open the upstream part of the third coin sorting route 17, as shown in FIG. 24.

The control apparatus not shown in the drawings also simultaneously operates the third denomination distributing lever 42 to open the upstream part of the seventh coin sorting route 41 and operates the fourth denomination distributing lever 50 to open the upstream part of the eighth coin sorting route 51.

As a result, as shown in FIG. 24, after the B-type coin that rolls in from the coin discrimination route 10 is guided by the genuine/false coin distributing lever 12 into the first coin sorting route 14, it is guided to the third coin sorting route 17 located below by the first denomination lever 15, then to the seventh coin sorting route 41 by the third denomination distributing lever 42, then to the eighth coin sorting route 51 by the fourth denomination distributing lever 50, and is then dropped from the bottom of the eighth coin sorting route 51 into the corresponding coin tube of the coin storage unit, where it is accumulated and stored.

Figure 25:
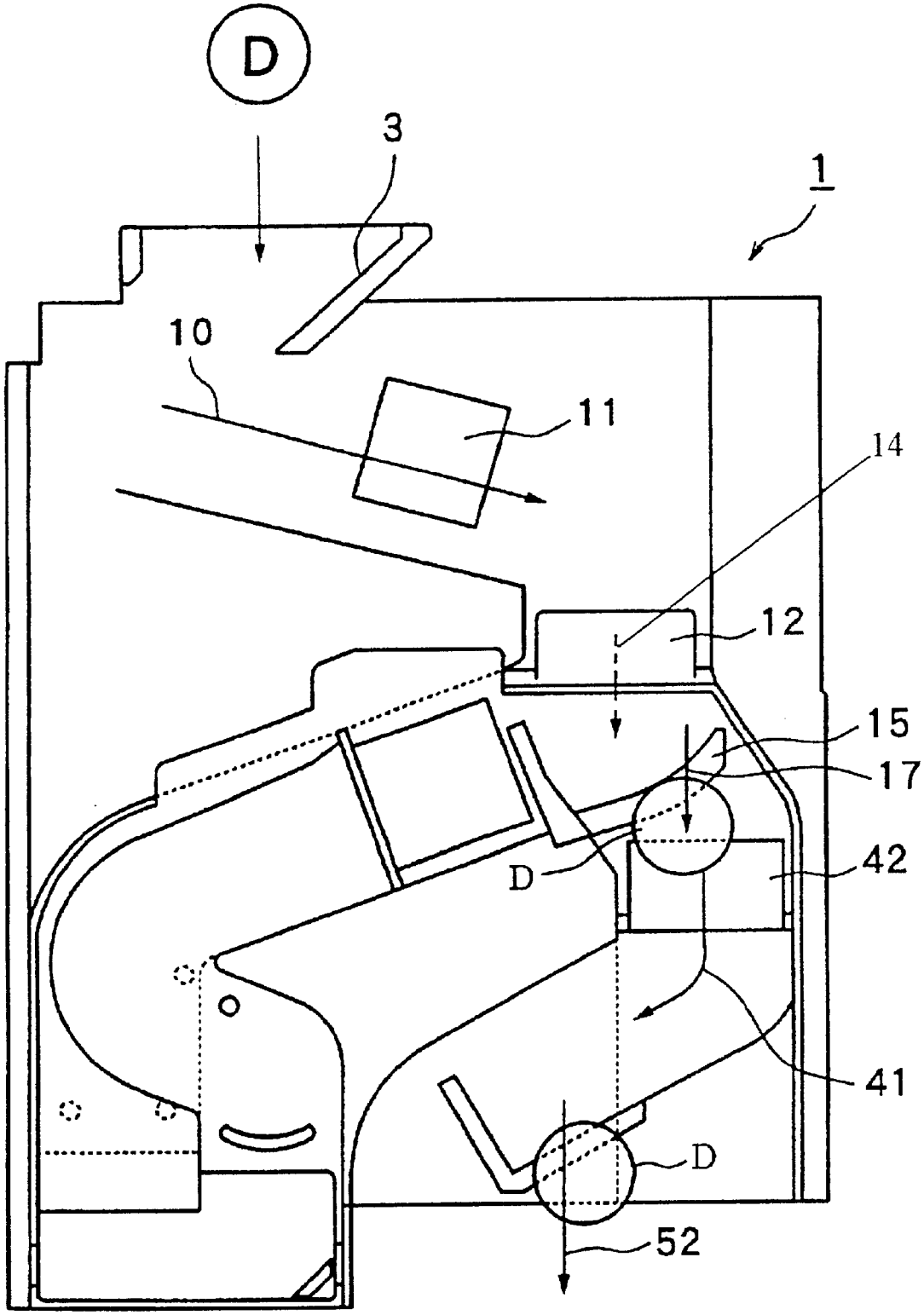
FIG. 25 is a schematic front elevation of the coin assorter showing the processing of a D-type coin.

If it is determined based on the detection signal from the coin discrimination sensor 11 that the coin inserted in the coin insertion inlet 3 is a D-type coin, the control apparatus not shown in the drawings operates the genuine/false coin distributing lever 12 to open the upstream part of the first coin sorting route 14 based, as well as the first denomination distributing lever 15 to open the upstream part of the third coin sorting route 17, as shown in FIG. 25.

The control apparatus not shown in the drawings also simultaneously operates the third denomination distributing lever 42 to open the upstream part of the seventh coin sorting route 41. The control apparatus not shown in the drawings further operates the fourth denomination distributing lever 50 to open the upstream part of the ninth coin sorting route 52.

As a result, after the D-type coin that rolls in from the coin discrimination route 10 is guided by the genuine/false coin distributing lever 12 into the first coin sorting route 14, it is guided to the third coin sorting route 17 located below by the first denomination lever 15, then to the seventh coin sorting route 41 by the third denomination distributing lever 42, then to the ninth coin sorting route 52 by the fourth denomination distributing lever 50, and is then dropped from the bottom of the ninth coin sorting route 52 into the corresponding coin tube of the coin storage unit, where it is accumulated and stored.

Where the number of coins stored in the above coin tubes that store B-type coins and D-type coins exceeds a certain maximum number, an overflow state results. The overflow processing carried out when the number of stored B-type coins and D-type coins exceeds a certain maximum number is described below.

After it is detected by the filled-up sensor mounted in the coin tube corresponding to the stored B-type coins or D-type coins that the number of stored D-type coins or B-type coins has reached a certain maximum number, if a coin that would trigger an overflow state is inserted, that coin is immediately stored in the cash box.

Accordingly, if it is detected by the filled-up sensor that the number of B-type coins stored in the coin tube not shown in the drawings has reached a certain maximum number, the coin assorter 1 described above carries out the following sorting operation.

Figure 26:
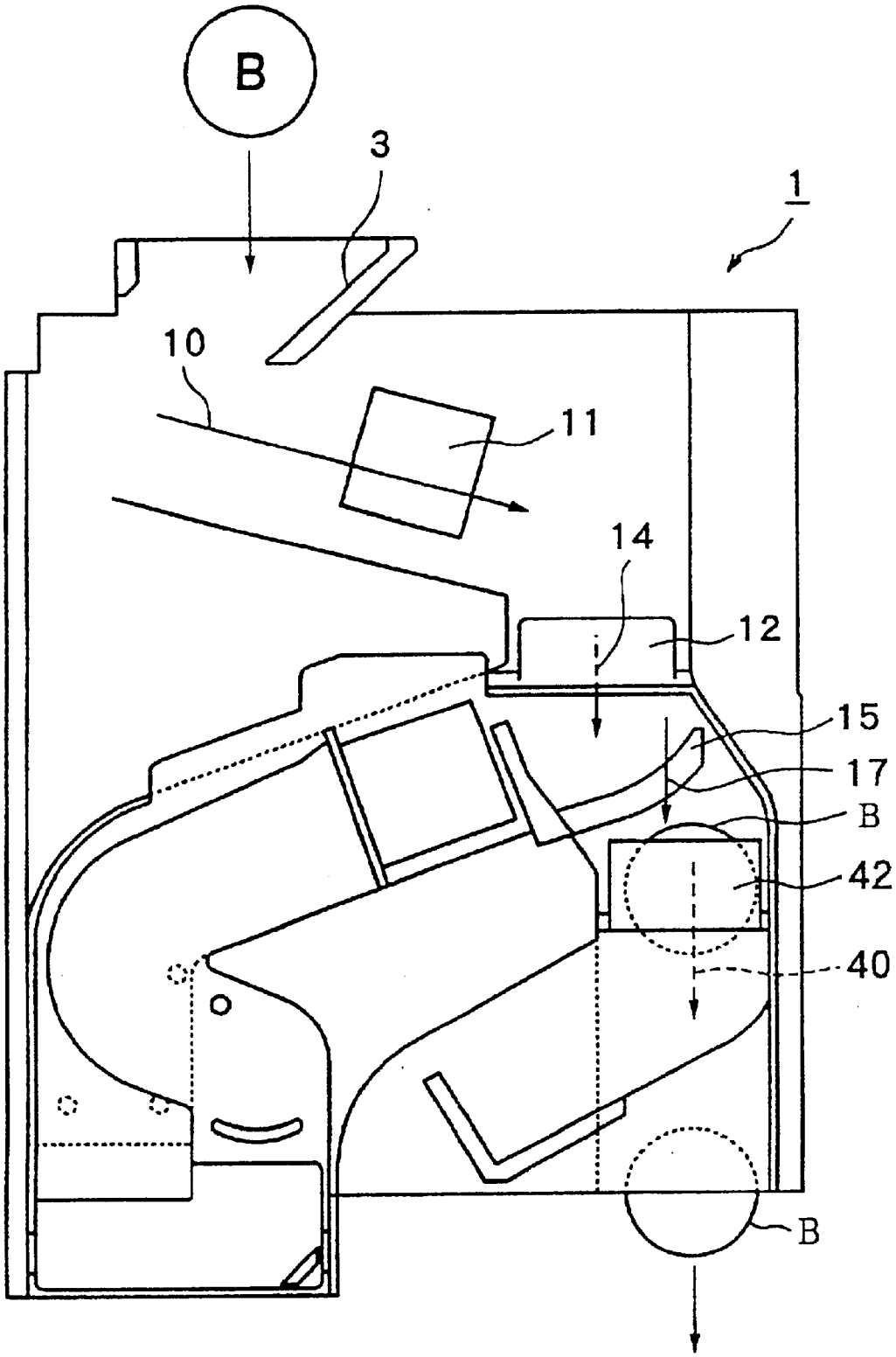
FIG. 26 is a schematic front elevation of the coin assorter showing the processing of a B-type coin when the coin capacity has been reached.

As shown in FIG. 26, if it is determined based on the detection signal from the coin discrimination sensor 11 that the coin inserted in the coin insertion inlet 3 is a B-type coin, and it is detected by the filled-up sensor that the number of B-type coins stored in the coin tube not shown in the drawings has reached a certain number, the control apparatus not shown in the drawings operates the genuine/false coin distributing lever 12 to open the upstream part of the first coin sorting route 14 based on these detection signals, and at the same time operates the first denomination distributing lever 15 to open the upstream part of the third coin sorting route 17. The control apparatus also simultaneously operates the third denomination distributing lever 42 to open the upstream part of the sixth coin sorting route 40.

When this is done, as shown in FIG. 26, the B-type coin that rolls in from the coin discrimination route 10 is guided by the genuine/false coin distributing lever 12 into the first coin sorting route 14, and is then guided to the third coin sorting route 17 located below by the first denomination lever 15. The B-type coin is then guided to the sixth coin sorting route 40 by the third denomination distributing lever 42, whereupon it is dropped from the bottom of the sixth coin sorting route 40 and immediately stored in the cash box not shown in the drawings that connects to the sixth coin sorting route 40.

Moreover, if it is detected by an overflow detection means not shown in the drawings that the number of coins accumulated and stored in the coin tube that stores D-type coins has reached a certain maximum number, the coin assorter 1 described above carries out the following sorting operation.

Figure 27:
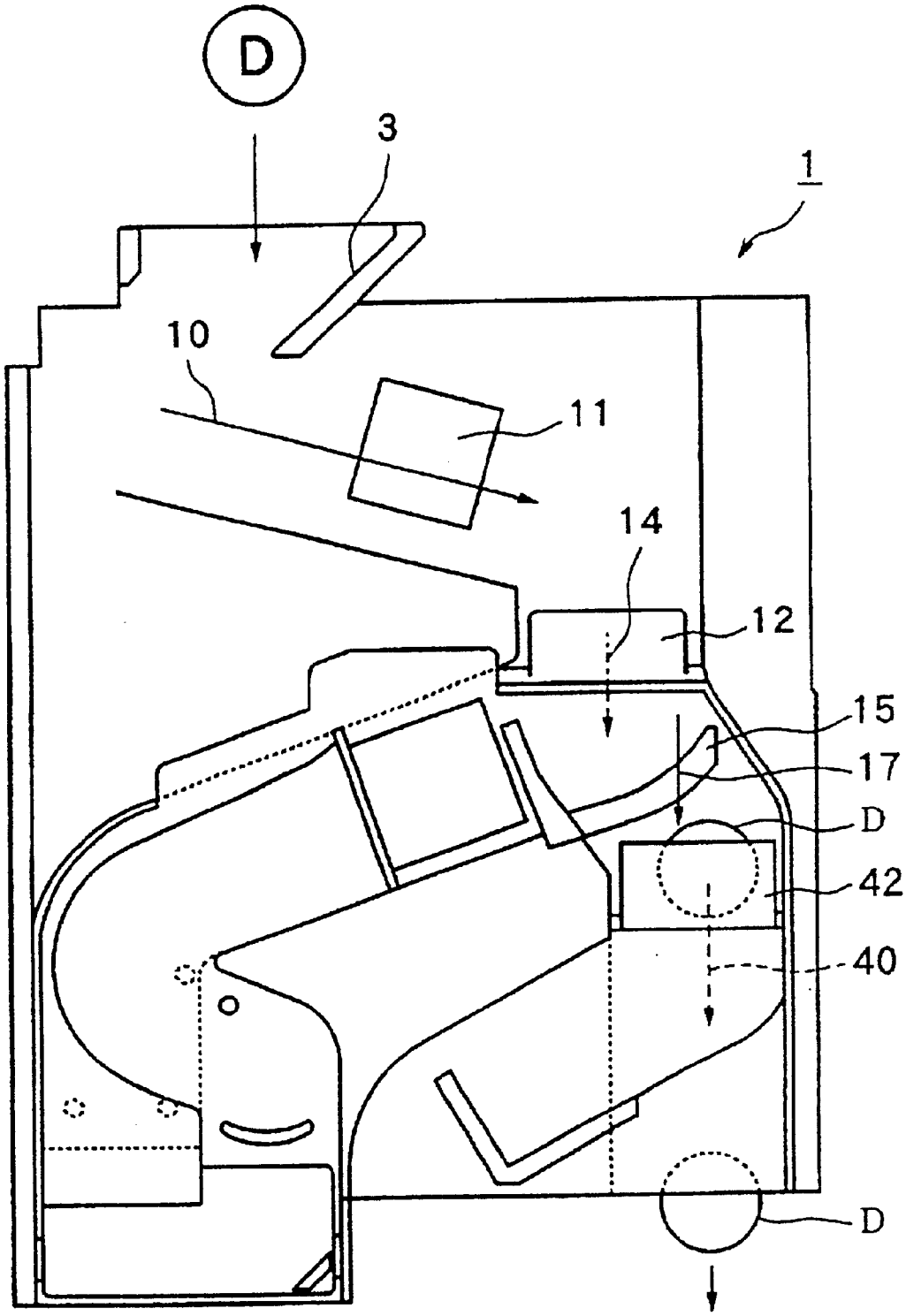
FIG. 27 is a schematic front elevation of the coin assorter showing the processing of a D-type coin when the coin capacity has been reached.

If it is determined based on the detection signal from the coin discrimination sensor 11 that the coin inserted in the coin insertion inlet 3 is a D-type coin, and it is detected by the filled-up sensor that the number of D-type coins stored in the coin tube not shown in the drawings has reached a certain maximum number, the control apparatus not shown in the drawings operates the genuine/false coin distributing lever 12 to open the upstream part of the first coin sorting route 14 based on these detection signals, and operates the first denomination distributing lever 15 to open the upstream part of the third coin sorting route 17, as shown in FIG. 27. The control apparatus also operates the third denomination distributing lever 42 to open the upstream part of the sixth coin sorting route 40.

When this is done, as shown in FIG. 27, the D-type coin that rolls in from the coin discrimination route 10 is guided by the genuine/false coin distributing lever 12 into the first coin sorting route 14, and is then guided to the third coin sorting route 17 located below by the first denomination lever 15. The D-type coin is then guided to the sixth coin sorting route 40 by the third denomination distributing lever 42, whereupon it is dropped from the bottom of the sixth coin sorting route 40 and immediately stored in the cash box not shown in the drawings that connects to the sixth coin sorting route 40.

As described above, according to the coin assorter of the present invention, because an individual coin route to which coin retaining means is connected is curved in essentially an S-shape upstream from the coin retaining means, such that the length of the individual coin route to which the coin retaining means is connected is set to be long, and a large number of coins can be temporarily retained therein, the number of inserted coins that can be temporarily retained is increased to the extent possible, and the occurrence of the coin switching phenomenon can be prevented to the extent possible, enabling an automatic vending machine to handle more costly products that require a large number of coins, thereby increasing the variety of products that can be offered.

INDUSTRIAL APPLICABILITY

As described above, the present invention is suitable for a coin assorter for an automatic vending machine that handles high-priced products requiring a large number of coins.

What is claimed is:

1. A coin assorter comprising coin discrimination means for determining whether inserted coins are genuine or false and denomination of genuine coins; a plurality of denomination distributing means for distributing by denomination coins determined as genuine into respective coin routes; and coin retaining means provided at downstream in the respective coin routes, for temporarily retaining the coins within the respective coin routes into which the coins are distributed, characterised in that:

said respective coin routes to which said coin retaining means is provided is curved substantially in an S-shape upstream from said coin retaining means, whereby the length of said respective coin routes to which said coin retaining means is provided is set to be long, so that a large number of coins can be temporarily retained therein.

2. The coin assorter according to claim 1, characterised in that said coin retaining means is provided respectively at an area downstream from one of the respective coin routes that guides largest denomination coins among the coins handled, and also at an area downstream from another one of the respective coin routes that guides second largest denomination coins.

3. The coin assorter according to claim 1, characterised in that said coin retaining means comprises a coin retaining lever that drops, intermittently one at a time, a plurality of coins that are retained in said respective coin routes; and a first coin distributing lever that distributes coins dropped one at a time by the coin retaining lever into either a coin return route or a coin storage route, and a second coin distributing lever that distributes the dropped coins into the coin storage route or a cash box route are juxtaposed downstream from the coin retaining lever.

4. The coin assorter according to claim 3, characterised in that said coin retaining lever comprises a lever rotatably supported around an shaft, having a C-shaped cross-section, top end and bottom end thereof protruding, wherein when the bottom end is caused to protrude into said respective coin routes with the top end being simultaneously retracted from said respective coin routes, the coin guided into said individual coin route is supported by said bottom end, and when the bottom end is retracted from said respective coin routes with the top end being simultaneously caused to protrude into the respective coin routes, the coin supported by said bottom end drops while a coin subsequent to the dropped coin simultaneously comes to be supported by said top end, and further when said bottom end is caused again to protrude into said respective coin routes with the top end being simultaneously retracted from said respective coin routes, the coin supported by said top end drops and comes to be supported by said bottom end.

* * * * *